US010791843B2

(12) United States Patent
Rowe, Jr.

(10) Patent No.: US 10,791,843 B2
(45) Date of Patent: Oct. 6, 2020

(54) PORTABLE SEAT AWNING

(71) Applicant: Ronald L. Rowe, Jr., Sturgis, MI (US)

(72) Inventor: Ronald L. Rowe, Jr., Sturgis, MI (US)

( * ) Notice: Subject to any disclaimer, the term of this patent is extended or adjusted under 35 U.S.C. 154(b) by 297 days.

(21) Appl. No.: 15/615,573

(22) Filed: Jun. 6, 2017

(65) Prior Publication Data

US 2017/0265646 A1 Sep. 21, 2017

Related U.S. Application Data

(63) Continuation-in-part of application No. 14/245,222, filed on Apr. 4, 2014, now Pat. No. 9,936,811.

(51) Int. Cl.

| | |
|---|---|
| ***A47C 7/66*** | (2006.01) |
| ***E04H 15/58*** | (2006.01) |
| ***E04H 15/46*** | (2006.01) |
| *E04H 15/02* | (2006.01) |

(52) U.S. Cl.

CPC ..... *A47C 7/66* (2013.01); *E04H 15/46* (2013.01); *E04H 15/58* (2013.01); *E04H 15/02* (2013.01)

(58) Field of Classification Search

CPC ..... E04H 15/44; E04H 15/46; E04H 15/58; A47C 7/66

See application file for complete search history.

(56) References Cited

U.S. PATENT DOCUMENTS 2,926,724 A * 3/1960 Rittenberg ..... A47C 7/66 297/40
4,687,249 A * 8/1987 Mills ..... A61G 5/10 297/183.5
5,096,257 A * 3/1992 Clark ..... A47C 1/143 297/184.15
5,168,889 A * 12/1992 Diestel ..... A47C 7/66 135/161
5,203,363 A * 4/1993 Kidwell ..... A47C 7/66 135/90
5,727,841 A * 3/1998 Morley ..... A47C 1/143 297/184.1
6,789,557 B1 * 9/2004 Wahl, Jr. ..... A47C 7/66 135/117
7,185,375 B1 * 3/2007 Movsas ..... A47K 11/04 4/480
7,243,990 B1 * 7/2007 Wahl ..... A47C 7/66 297/184.15
7,431,389 B2 * 10/2008 Reeb ..... A47C 7/66 135/95

(Continued)

*Primary Examiner* — David R Dunn

*Assistant Examiner* — Danielle Jackson

(74) *Attorney, Agent, or Firm* — Larry E. Henneman, Jr.; Henneman & Associates, PLC

(57) ABSTRACT

A novel portable bleacher/bench awning includes a first seat engaging structure, a second seat engaging structure, a first frame structure, a second frame structure, and a flexible cover. The first and second seat engaging structures are adapted to engage a bleacher/bench type seat. Optionally, the portable awning is collapsible. In another particular embodiment, the portable awning is adapted to be mounted to a chair via a bag that is also used to transport the portable awning. In other particular embodiment(s), the height and/or width of the portable awning frame are continuously adjustable. In still other embodiment(s), a seat engaging structure is adapted to mount the portable awning frame to a collapsible chair, wheel chair, etc.

18 Claims, 19 Drawing Sheets

(56) References Cited

U.S. PATENT DOCUMENTS

| | | | | |
|---|---|---|---|---|
| 7,740,310 | B1 * | 6/2010 | Forster | A47C 7/66 135/96 |
| 7,753,063 | B1 * | 7/2010 | Laws | A47C 7/66 135/117 |
| 9,936,811 | B2 * | 4/2018 | Rowe, Jr. | A47C 7/66 |
| 2002/0112752 | A1 * | 8/2002 | Blakney | A47C 7/66 135/96 |
| 2006/0054207 | A1 * | 3/2006 | Wootliff | A47C 7/66 135/96 |
| 2007/0102976 | A1 * | 5/2007 | Ramsey | A47C 4/52 297/248 |
| 2018/0279789 | A1 * | 10/2018 | Guerrier | A47C 1/14 |

* cited by examiner

PORTABLE SEAT AWNING

CROSS-REFERENCE TO RELATED APPLICATIONS

This application is a continuation-in-part of co-pending U.S. patent application Ser. No. 14/245,222, filed Apr. 4, 2014 by the same inventor, which is incorporated herein by reference in its entirety.

BACKGROUND OF THE INVENTION

Field of the Invention

This invention relates generally to awning devices, and more particularly to portable awning devices. Even more particularly, this invention relates to portable awning devices configured for attachment to seating.

Description of the Background Art

Bleachers and benches are among the most common forms of seating in many outdoor event venues. In general, bleachers and benches are intended to provide the most cost effective solution to seating as many spectators as possible. In achieving this goal, personal comfort and protection from the elements (i.e., rain, sun, wind, etc.) is often sacrificed.

In effort to increase personal comfort and protection from the elements while attending outdoor events, many types of canopy devices have been developed. For example, U.S. Pat. No. 4,086,931 (Hall) teaches an umbrella shelter that is adapted to detachably mount to a stadium bench. The umbrella includes a base that hooks around a bench and includes a vertical pole socket. The pole socket supports an umbrella pole that further supports an umbrella frame. The umbrella frame includes a number of structures (e.g., ribs, struts, spring elements, etc.) that support a piece of fabric.

Although the umbrella shelter of Hall provides some protection from the elements, there are several disadvantages inherent to the design. For example, umbrellas are structurally unstable in high winds. As another example, the umbrella shelter design of Hall is relatively complicated in that it includes a high number of moving parts. Consequently, the umbrella shelter of Hall is difficult to use and transport.

What is needed, therefore, is a portable canopy device that is capable of withstanding extreme conditions. What is also needed is a portable canopy device having a less complicated design that is easier to operate and more convenient to transport.

SUMMARY

The present invention overcomes the problems associated with the prior art by providing a portable seat awning that can be coupled to either a bleacher/bench style seat or a lawn chair.

The portable seat awing includes a first seat engaging structure, a second seat engaging structure, a first frame structure, a second frame structure, and a flexible cover. The first seat engaging structure is disposed on a first side of the portable seat awning. The second seat engaging structure is disposed on a second side of the portable seat awning. The first frame structure is coupled to the first seat engaging structure and is disposed on the first side of the portable awning. The second frame structure is coupled to the second seat engaging structure and is disposed on the second side region of the portable awning. The flexible cover includes a first region that is coupled to the first frame structure and a second region that is coupled to the second frame structure.

In an example embodiment, the first seat engaging structure and the second seat engaging structure are horizontally adjustable to accommodate for various seat depths (i.e., front to back dimension). In a more particular example embodiment, the first seat engaging structure includes a first portion and a second portion. The first portion of the first seat engaging structure is adapted to engage a top surface of a seat, and the second portion of the first seat engaging structure is adapted to engage a bottom surface of the seat. The first portion of the first seat engaging structure and the second portion of the first seat engaging portion are coupled in a telescoping relationship. The second seat engaging structure includes a first portion and a second portion. The first portion of the second seat engaging structure is adapted to engage a top surface of the seat, and the second portion of the second seat engaging structure is adapted to engage a top surface of the seat. The first portion of the second seat engaging structure and the second portion of the second seat engaging portion are coupled in a telescoping relationship. In an even more particular example embodiment, the first portion of the first seat engaging structure is coaxially aligned with the second portion of the first seat engaging structure, and the first portion of the second seat engaging structure is coaxially aligned with the second portion of the second seat engaging structure. The first portion of the first seat engaging structure is pivotally coupled to the second portion of the first seat engaging structure, and the first portion of the second seat engaging structure is pivotally coupled to the second portion of the second seat engaging structure.

In the example embodiment, the first seat engaging structure is pivotally coupled to the first frame structure, and the second seat engaging structure is pivotally coupled to the second frame structure. In addition, the first seat engaging structure includes a first arm rest, and the second seat engaging structure includes a second arm rest. The first frame structure and the second frame structure are both adapted to engage a rear surface of a seat.

An example first frame structure includes a first vertical section and a first horizontal section, and an example second frame structure includes a second vertical section and a second horizontal section. The example portable seat awning further includes a third horizontal section coupled between the first vertical section and the second vertical section, and a fourth horizontal section coupled between the first horizontal section and the second horizontal section. The first horizontal section and the second horizontal section are coupled to the forth horizontal section.

In the example embodiment, the third and fourth horizontal sections of the portable seat awning are both collapsible. In addition, the first horizontal section of the first frame structure is collapsible with respect to the first vertical section of the first frame structure. Similarly, the second horizontal portion of the second frame structure is collapsible with respect to the second vertical section of the second frame structure.

Also, in the example embodiment, the first vertical section of the first frame structure includes an upper portion and a lower portion. The upper portion of the first vertical section is coupled to the first horizontal portion, and the lower portion of the first vertical section is coupled to the first seat engaging structure. Similarly, the second vertical section of the second frame structure includes an upper portion and a lower portion. The upper portion of the second vertical section is coupled to the second horizontal portion, and the lower portion of the second vertical section is coupled to the second seat engaging structure. The upper portion and the lower portion of the first vertical section are coupled in an adjustable, telescoping relationship, and the upper portion and the lower portion of the second vertical section are also coupled in an adjustable, telescoping relationship. In a described embodiment, the lower portion of the first vertical section and the lower portion of the second vertical section are adapted to engage a rear portion of a seat.

In an alternate embodiment, the portable seat awning further includes a flexible seat engaging member adapted to engage a chair backrest. The flexible seat engaging member includes a first frame structure receiving feature and a second frame structure receiving feature. The first frame structure receiving feature is adapted to receive and support the first frame structure, and the second frame structure receiving feature is adapted to receive and support the second frame structure.

In a more specific example, the flexible seat engaging member is a bag adapted to transport the portable seat awning. The bag includes an opening large enough to receive a chair backrest. The first frame structure receiving feature includes a first sleeve that is fixed to the bag and adapted to receive the first frame structure. The second frame structure receiving feature includes a second sleeve that is fixed to the bag and adapted to receive the second frame structure. The first seat engaging structure and the second seat engaging structure are removable from the rest of the portable seat awning, to facilitate insertion of the first frame structure and the second frame structure into the first sleeve and second sleeve, respectively.

In one embodiment, portable awning comprises a first frame structure, a second frame structure, a flexible cover, and a flexible seat engaging member. The first frame structure is disposed on a first side region of the portable awning. The second frame structure is disposed on the second side region of the portable awning. The flexible cover includes a first region and a second region. The first region of the flexible cover is coupled to the first frame structure. The second region of the flexible cover is coupled to the second frame structure. The flexible seat engaging member is adapted to engage a chair backrest. The flexible seat engaging member includes a first frame structure receiving feature and a second frame structure receiving feature. The first frame structure receiving feature is adapted to receive the first frame structure and the second frame structure receiving feature is adapted to receive the second frame structure.

In another example of the embodiment, the flexible seat engaging member is a bag operative to carry the first frame structure, the second frame structure, and the flexible cover. In an even more specific example, the bag includes an opening, a first sleeve, and a second sleeve. The opening is adapted to receive a chair backrest. The first sleeve is adapted to receive the first frame structure, and the second sleeve is adapted to receive the second frame structure. In this particular embodiment, the entire awning fits in and can be carried by the bag.

In this example of the embodiment, each of the first frame structure and the second frame structure include a vertical section and a horizontal section. The first sleeve on the bag is adapted to receive the vertical section of the first frame structure, and the second sleeve on the bag is adapted to receive the vertical section of the second frame structure. The horizontal section of the first frame structure is collapsible with respect to the vertical section of the first frame structure, and the horizontal section of the second frame structure is collapsible with respect to the vertical section of the second frame structure. The example portable seat awning further includes a collapsible horizontal section coupled between the horizontal section of the first frame structure and the horizontal section of the second frame structure.

A portable seat awning according to still another embodiment includes a first frame structure configured to be disposed on a first side of the portable seat awning, a second frame structure configured to be disposed on a second side of the portable seat awning, a collapsible third frame structure configured to be disposed between the first frame structure and the second frame structure, a flexible cover, and a flexible seat engaging structure. The flexible cover has a first region configured to be coupled to the first frame structure and a second region configured to be coupled to the second frame structure. Additionally, the flexible seat engaging structure is configured to engage a chair backrest and has first and second frame structure receiving features configured to receive the first and second frame structures, respectively.

According to one particular embodiment, the third frame structure includes a first end pivotally coupled to the first frame structure and a second end pivotally coupled to the second frame structure. Even more particularly, the third frame structure includes a removable structure configured to be disposed between the first end and the second end of the third frame structure.

According to another particular embodiment, the length of the third frame structure is continuously adjustable.

According to yet another particular embodiment, at least a portion of the third frame structure is detachable from the first frame structure and the second frame structure. More particularly, the flexible seat engaging structure includes a pouch configured to receive the detachable portion of the third frame structure.

According to still another particular embodiment, the third frame structure includes a first member and a second member, where the first member includes a first end and a second end, and the second member includes a first end and a second end. Additionally, the first end of the first member is pivotally coupled to the first frame structure, the first end of the second member is pivotally coupled to the second frame structure, and the second end of the first member is configured to detachably engage the second end of the second member. In a more particular embodiment, the third frame structure includes a plurality of telescoping members and a position retainer configured to retain the plurality of telescoping members in a desired position.

In yet another particular embodiment, the first frame structure includes a first vertical section being adjustable in height, and the second frame structure includes a second vertical section being adjustable in height. In a more particular embodiment, the first vertical section includes a first plurality of telescoping members, the second vertical section includes a second plurality of telescoping members, and the first and second pluralities of telescoping members are continuously adjustable along a predetermined length. In an even more particular embodiment, the portable seat awning further includes a first position retainer configured to retain the first plurality of telescoping members in a first desired position, and a second position retainer configured to retain the second plurality of telescoping members in a second desired position. The first and second position retainers can comprise a turn-lock mechanism. In another more particular embodiment, the first frame structure includes a first horizontal section pivotally coupled between the first vertical section and the third frame structure, and the second frame structure includes a second horizontal section pivotally coupled between the second vertical section and the third frame structure. Still more particularly, the first horizontal section includes a first bend turning inward, and the second horizontal section includes a second bend turning inward.

In another particular embodiment, a distance between the first frame structure and the second frame structure is adjustable to accommodate chair backrests of varying widths.

In yet another particular embodiment, the flexible seat engaging structure includes at least one width adjustment feature to accommodate for chair backrests of varying widths. In a more particular embodiment, the width adjustment feature includes a hook substrate and a loop substrate, where one of the hook substrate and the loop substrate is coupled to the front of the flexible seat engaging structure and aligned substantially horizontally, and the other of the hook substrate and the loop substrate is coupled to the back of the flexible seat engaging feature and aligned substantially vertically.

In still another particular embodiment, the flexible seat engaging structure is configured to engage the backrest of a chair having a plurality of frame members configured to automatically position themselves vertically when the chair is collapsed.

In another particular embodiment, the flexible seat engaging structure includes a plurality of wheel chair couplers configured to engage a respective plurality of push handles of a wheel chair.

In yet another particular embodiment, the portable seat awning further includes a bag configured to receive the portable seat awning in a collapsed state. The bag defines an opening having a diameter less than the distance between the first and the second frame structures when the portable awning is in a deployed state.

A seat engaging structure according to an embodiment of the invention includes a flexible front portion configured to abut a front surface of a chair backrest, a flexible rear portion disposed with respect to the front portion to pass behind the chair backrest, a fastener, and a receiver. The fastener is fixed to at least one of the front portion and the rear portion and is adapted to couple the front portion and the rear portion to secure the seat engaging structure to the chair backrest. Additionally, at least a portion of the fastener is oriented substantially vertically when the seat engaging structure is positioned on the chair backrest. Furthermore, the receiver is coupled to at least one of the flexible front portion and the flexible rear portion and is configured to receive a support structure of an awning.

In a particular embodiment, the fastener includes a set of fasteners fixed to the front portion and a set of complementary fasteners fixed to the rear portion and configured to engage the set of fasteners. Additionally, one of the set of fasteners and the set of complementary fasteners is oriented substantially vertically when the seat engaging structure is positioned on the chair backrest. In a more particular embodiment, the set of fasteners comprises one of hook fasteners and loop fasteners of a hook-and-loop material, and the set of complementary fasteners comprises the other of the hook fasteners and the loop fasteners of the hook-and-loop material.

In another particular embodiment, the seat engaging structure includes a pouch coupled to the flexible rear portion, where the pouch is configured to receive a component of the support structure of the awning therein.

A method of manufacturing a seat engaging structure according to the invention includes the steps of providing a single sheet of material, forming a first portion of the sheet configured to abut a front surface of a chair backrest, forming a second portion of the sheet to be disposed with respect to the front portion and to pass behind the chair backrest, and forming an intermediate portion of the sheet to extend from the first portion to the second portion and disposed to rest upon a top of the chair backrest when the seat engaging structure is positioned on the chair backrest. The method also includes the steps of attaching a set of receivers to the second portion of the sheet, and attaching at least one fastener to one of the first portion and the second portion of the sheet. The fastener is configured to couple the first portion to the second portion of the sheet around the chair backrest, and at least a portion of the fastener is oriented substantially vertically when the seat engaging structure is positioned on the chair backrest. Additionally, each receiver is configured to receive an elongated support structure.

A method of manufacturing a portable seat awning according to the invention includes the steps of forming a first frame structure configured to be disposed on a first side of the portable seat awning, forming a second frame structure configured to be disposed on a second side of the portable seat awning, forming a collapsible third frame structure configured to be disposed between the first frame structure and the second frame structure, forming a flexible cover, and forming a flexible seat engaging structure configured to engage a chair backrest. The flexible cover includes a first region configured to be coupled to the first frame structure and a second region coupled to the second frame structure. Additionally, the flexible seat engaging structure has first and second frame structure receiving features configured to receive the first and the second frame structures, respectively.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a simplified portable awning that is adapted to mount on a bleacher/bench type seat or the back of a lawn chair, folding chair, wheel chair, etc. In the following description, numerous specific details are set forth (e.g., fabric types, frame elements, etc.) in order to provide a thorough understanding of the invention. Those skilled in the art will recognize, however, that the invention may be practiced apart from these specific details. In other instances, details of well-known tube manufacturing practices (e.g., tube bending, welding, etc.) and components have been omitted, so as not to unnecessarily obscure the present invention.

Figure 1:
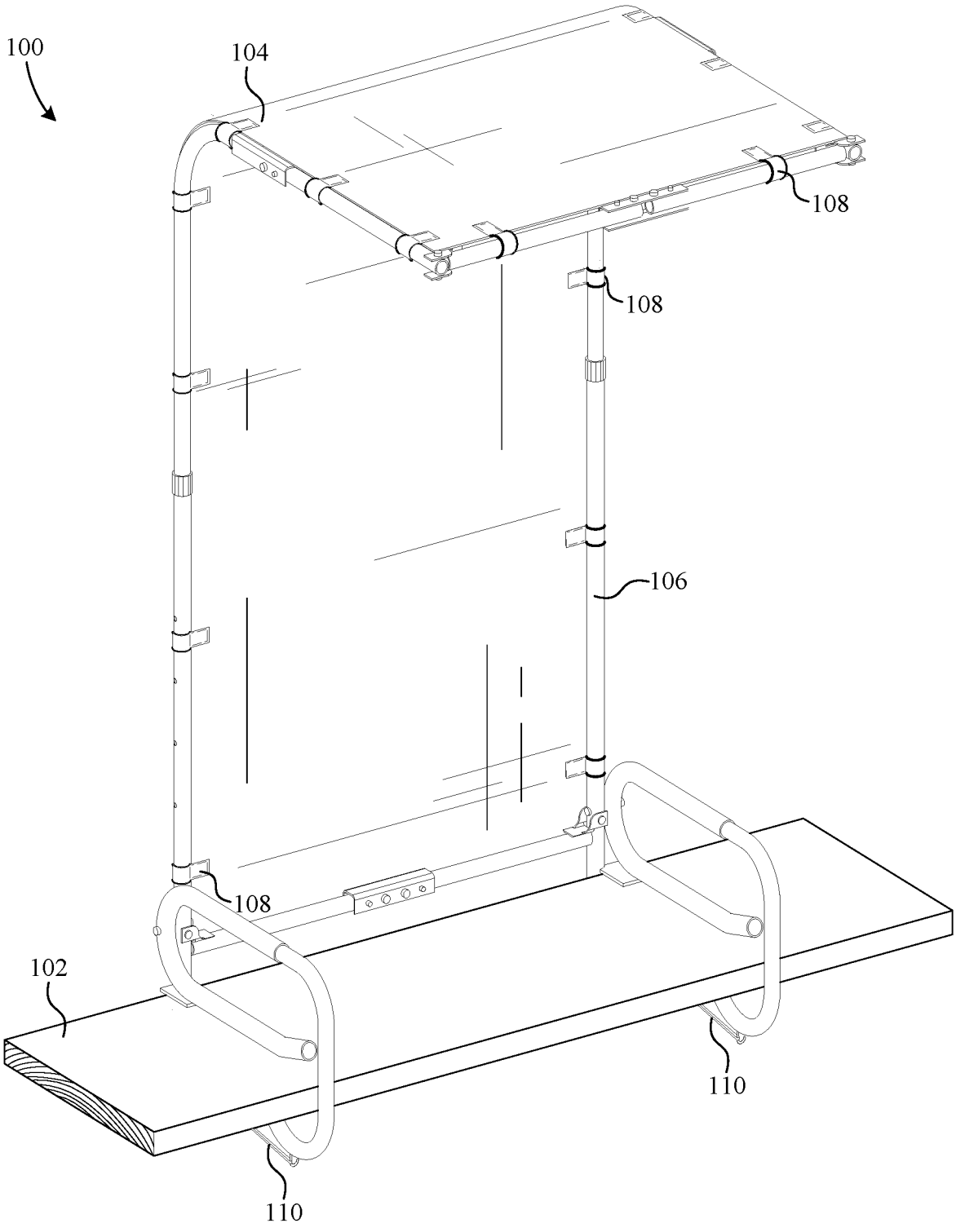
FIG. 1 is a perspective view of a portable awning.

FIG. 1 shows a perspective view of a portable seat awning 100 mounted on a seat 102 which, in this example, is a bleacher/bench type seat. Awning 100 can be universally attached to, and detached from, any suitable bleacher/bench type seat (e.g., stadium seating, picnic tables, etc.). Awning 100 includes a flexible fabric 104 coupled to a frame 106 via a plurality of fasteners 108. Fabric 104 is, for example, an opaque material that is wind and water proof. Accordingly, fabric 104 protects a user from sunlight, wind, and rain. In this particular embodiment, fasteners 108 are hook-and-loop fasteners attached to the peripheral edge of fabric 104 and wrapped around frame 106. As shown, an elastic cord (e.g., a bungee cord) 110 is used to secure frame 106 onto seat 102.

Figure 2:
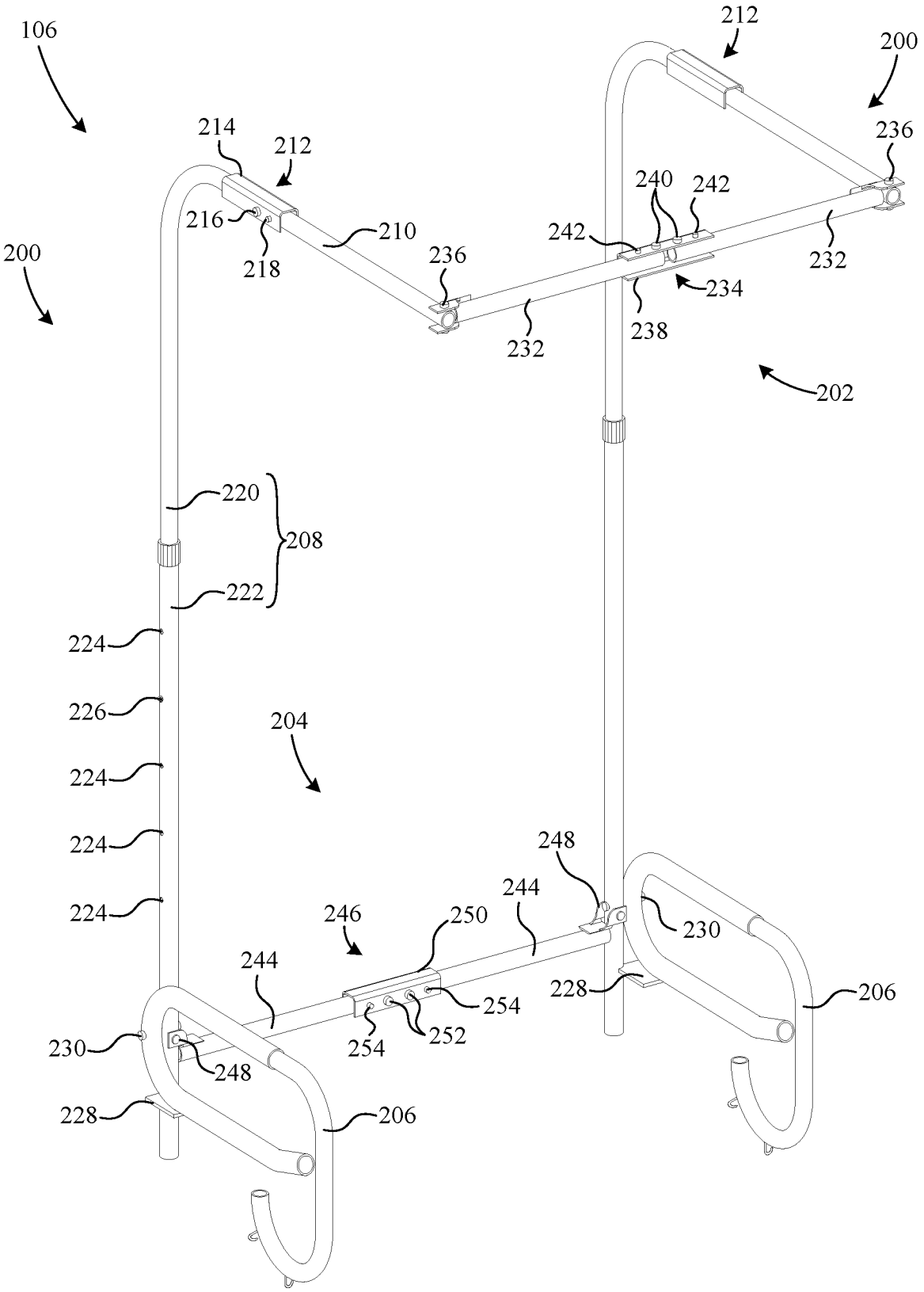
FIG. 2 is a perspective view of a frame of the portable awning of FIG. 1.

FIG. 2 shows a perspective view of frame 106 in an open/erected condition. Frame 106 includes a set of frame side structures 200, a first horizontal section 202, a second horizontal section 204, and two seat engaging structures 206. Each of frame side structures 200 includes a vertical section 208 and a horizontal section 210. Each of vertical sections 208 is coupled to a respective one of horizontal sections 210 via a respective locking feature 212. Each of locking features 212 includes a U-shaped element 214, a hinge pin 216, and a push tab 218. U-shaped element 214 is, for example, a short section of channel stock. Hinge pins 216 facilitate the pivoting of horizontal sections 210 with respect to vertical sections 208. Push tabs 218 extend from horizontal sections 210 and are shown disposed in holes formed in the sides of u-shaped elements 214.

Each vertical section 208 includes an upper portion 220 and a lower portion 222. As shown, the diameter of lower portion 222 is slightly larger than that of upper portion 220 such that upper portion 220 and lower portion 222 are coupled in a telescoping relationship. Lower portion 222 also includes a plurality of holes 224 that receive push tabs 226 of upper portion 220. Holes 224 and push tabs 226 enable the height of frame structures 200 to be adjusted according to user preference. Each of lower portions 222 further includes a plate 228 rigidly attached thereto by some suitable means such as, for example, welding. Plate 228 is adapted to engage the top surface of seat 102 while also limiting the distance at which seat engaging structures 206 can be rotated. Each of lower portions 222 are pivotally coupled to a respective one of seat engaging structures 206 via a hinge pin 230.

First horizontal section 202 includes two straight tubes 232 and a locking feature 234. Each straight tube 232 is pivotally coupled to a respective one of horizontal sections 210 via hinge elements 236. Locking feature 234 includes a U-shaped element 238, hinge pins 240, and push tabs 242. When push tabs 242 engage apertures on U-shaped element 238, first horizontal section 202 is locked in a straight condition. Hinge elements 236 and hinge pins 240 also enable first horizontal section 202 to be collapsed when push tabs 242 are pressed in to disengage the apertures of U-shaped element 238.

Second horizontal section 204 includes two straight tubes 244 and a locking feature 246. Each straight tube 244 is pivotally coupled to a respective one of lower portions 222 via hinge elements 248. Locking feature 246 includes a U-shaped element 250, hinge pins 252, and push tabs 254, and operates similar to locking feature 234 described above. Hinge elements 248 and hinge pins 252 enable second horizontal section 204 to be selectively locked or collapsed when push tabs 254 are engaged or disengaged from apertures in U-shaped element 250.

Seat engaging structures 206 are adapted to universally engage various sized bleacher/bench type seats including, for example, seat 102 of FIG. 1. As shown, seat engaging structures 206 are pivotally coupled to lower portions 222 of vertical sections 208 via hinge pins 230. In the example embodiment, seat engaging structures 206 also function as arm rests.

Figure 3:
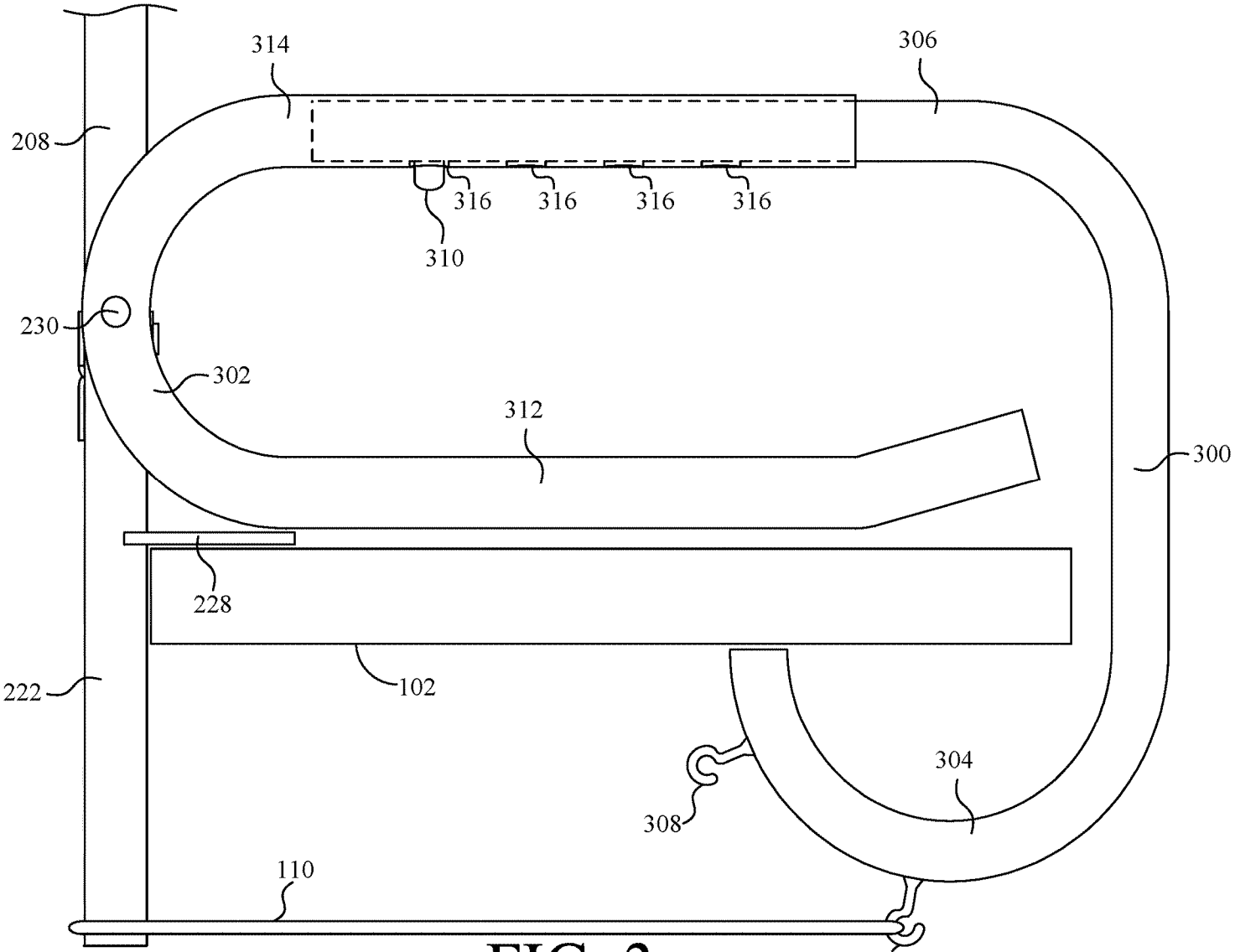
FIG. 3 is side view of a seat engaging structure of the frame of FIG. 2.

FIG. 3 is a side view of seat engaging structure 206. Seat engaging structure 206 includes a first portion 300 and a second portion 302. In the example embodiment, first portion 300 and second portion 302 are formed from bent tubing. The outer diameter of first portion 300 is less than the inner diameter of second portion 302, so that an end of first portion 300 can fit into an end of second portion 302. As shown, a segment of first portion 300 is coaxially aligned with, and inserted in, second portion 302 such that first portion 300 and second portion 302 are coupled in a telescoping fashion. First portion 300 includes a bottom region 304 and a top region 306. Bottom region 304 is curved to facilitate engagement of the rear surface of seat 102. In addition, bottom region 304 includes a set of hooks 308 extending therefrom. Hooks 308 facilitate the securement of frame 106 to seat 102 via an elastic cord 110. As shown, elastic cord 110 urges lower portion 222 of vertical section 208 toward bottom region 304 of seat engaging structure 206, thereby securing vertical section 208 in an upright position. Top region 306 includes a push tab 310 for locking first portion 300 into second portion 302 by engaging apertures 316 in second portion 302. Second portion 302 includes a bottom region 312 and a top region 314. Bottom region 312 is adapted to engage the top surface of seat 102. Top region 314 is coaxially aligned to receive top region 306 of first portion 300. As shown, top region 314 includes a plurality of apertures 316 adapted to receive push tab 316. Apertures 316 and push tab 310, together, enable the distance between first portion 300 and second portion 302 to be changed so as to adjust to various seat depths (i.e., the dimension from the front of seat 102 to the rear of seat 102).

Figure 4:
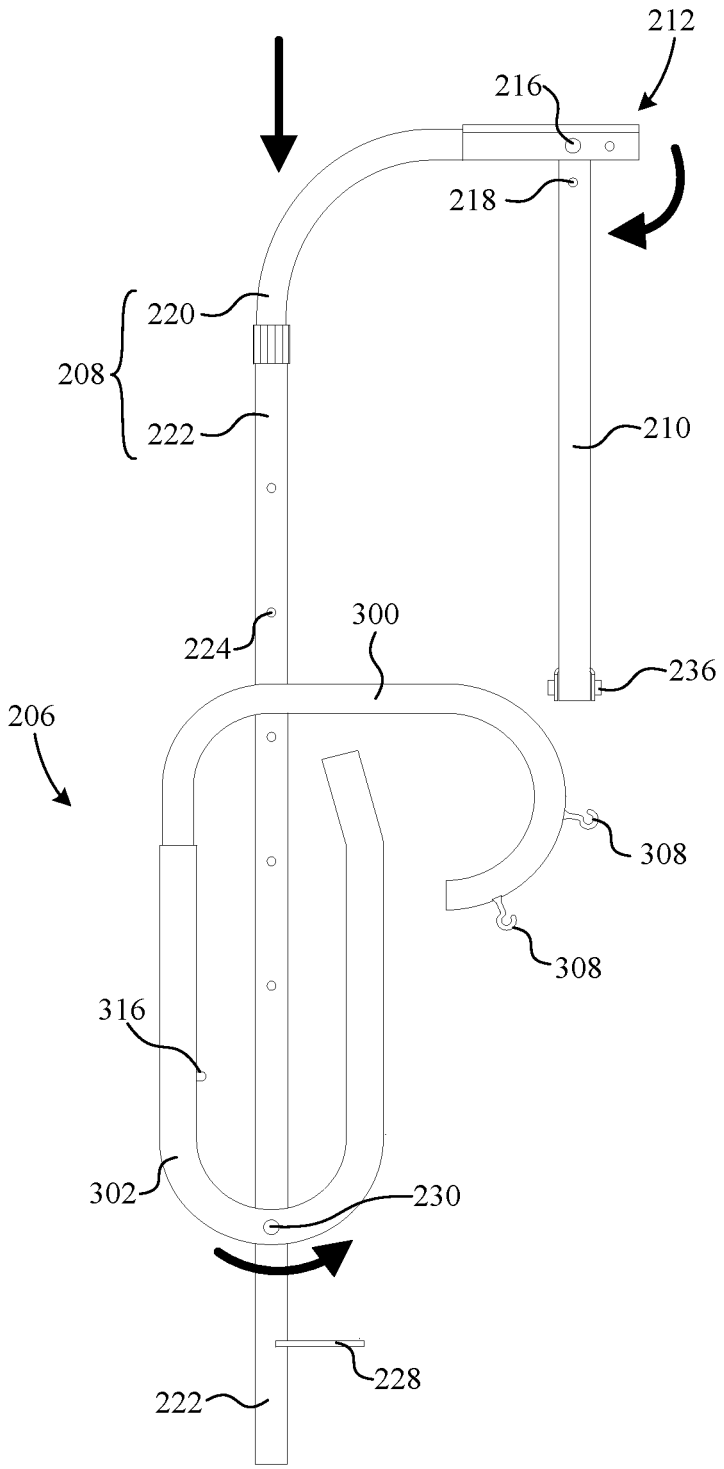
FIG. 4 is side view of the frame of FIG. 2 in a partially collapsed position.
Figure 5:
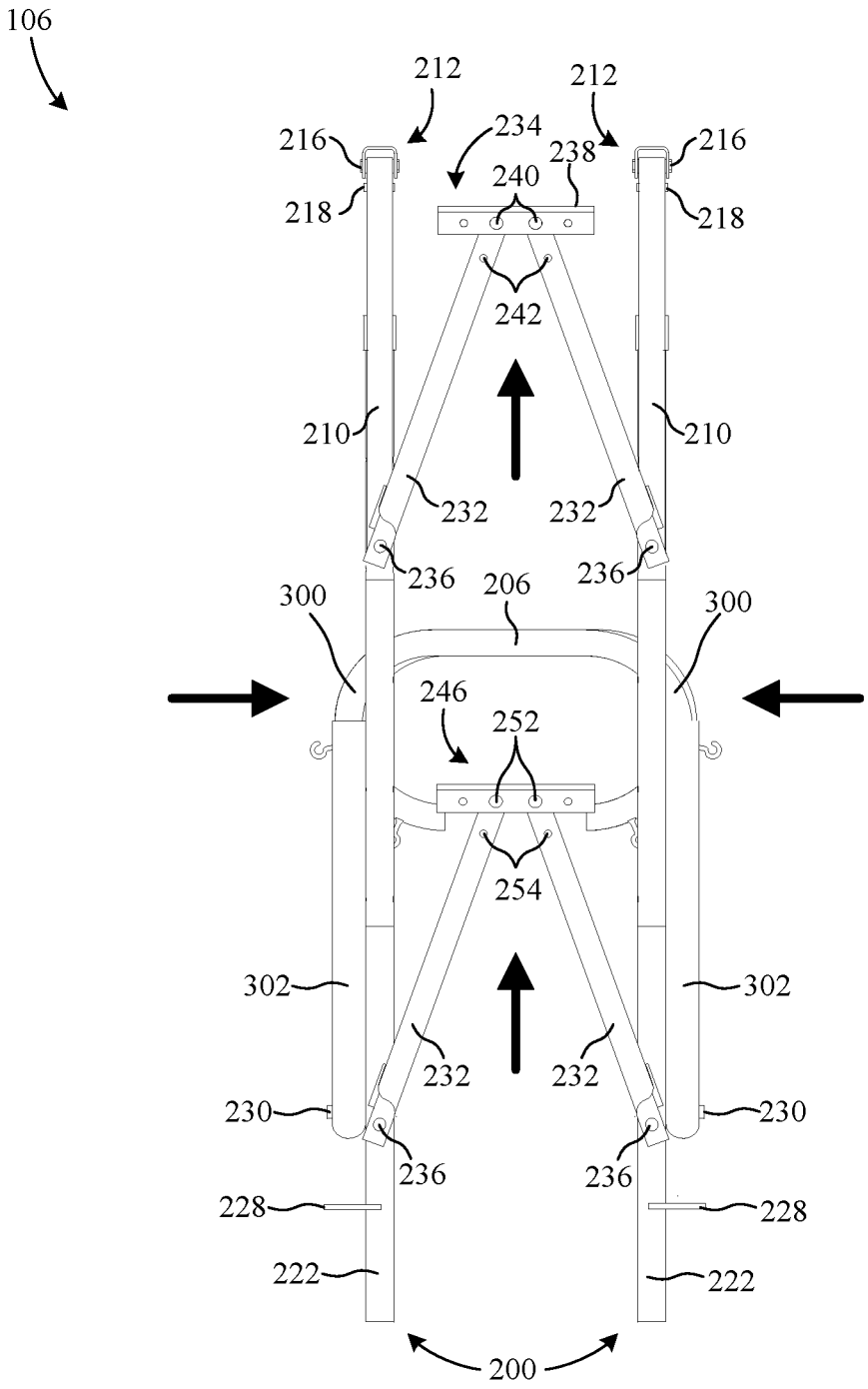
FIG. 5 is a front view of the frame of FIG. 2 in a partially collapsed position.

The collapsing of frame 106 is described with reference to FIG. 4 and FIG. 5. First, push tabs 218 are simultaneously pressed in, thereby releasing horizontal sections 210 to pivot 90° downward about hinge elements 216. Next, vertical section 208 is collapsed by pressing push tabs 226 back through holes 224 and then urging upper portion 220 of vertical section 208 into lower portion 222 of vertical section 208. Then, both seat engaging structures 206 are pivoted upward 90° about hinge element 230 as shown in FIG. 4. Next, first horizontal section 202 and second horizontal section 204 are broken down by pressing in push tabs 242 and 254 (FIG. 5). With push tabs 242 and 254 pressed in, elements 238 and 250 are urged upward thereby drawing frame side structures 200 together. Finally, first portions 300 of seat engaging structures 206 are rotated back and folded inward as shown in FIG. 5. To hold frame 106 in a collapsed position, elastic cord 112 can be wrapped around frame 106 and looped back around hooks 308.

Figure 6:
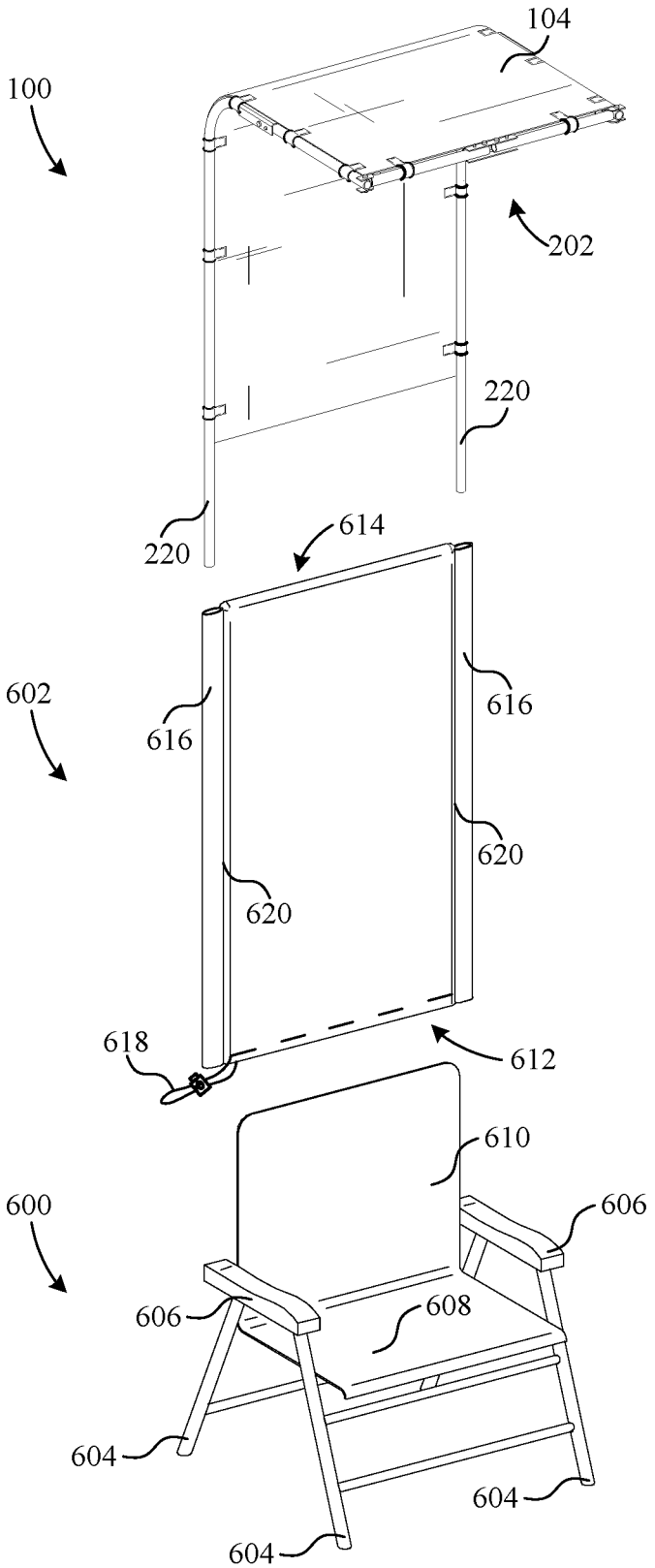
FIG. 6 is a perspective view of a portable awning according to another embodiment of the present invention.

FIG. 6 illustrates another feature of the present invention, whereby portable seat awning 100 is adapted to be mounted to a chair 600 via a bag 602. In this example, chair 600 is a foldable lawn chair that includes a set of legs 604, a set of armrests 606, a seat 608, and a backrest 610. Bag 602 facilitates the transportation of portable seat awning 100 and also facilitates the coupling of portable seat awning 100 to chair 600. Bag 602 includes an open end 612, a bottom end 614, and a set of sleeves 616. Open end 612 is sufficiently large so that portable seat awning 100 can be placed into bag 602. Additionally, open end 612 is designed to receive backrests of a variety of different sized chairs, such as backrest 610 of chair 600. Open end 612 is closable via a pull string 618. Each of sleeves 616 is formed on a respective side of bag 602 by, for example, stitching 620 that extends completely down each side of bag 602. As shown, bottom ends 614 of sleeves 616 are both open so as to receive upper portions 220 of vertical sections 208. Optionally, sleeves 616 can be fixed to the rear side of bag 602.

Figure 7:
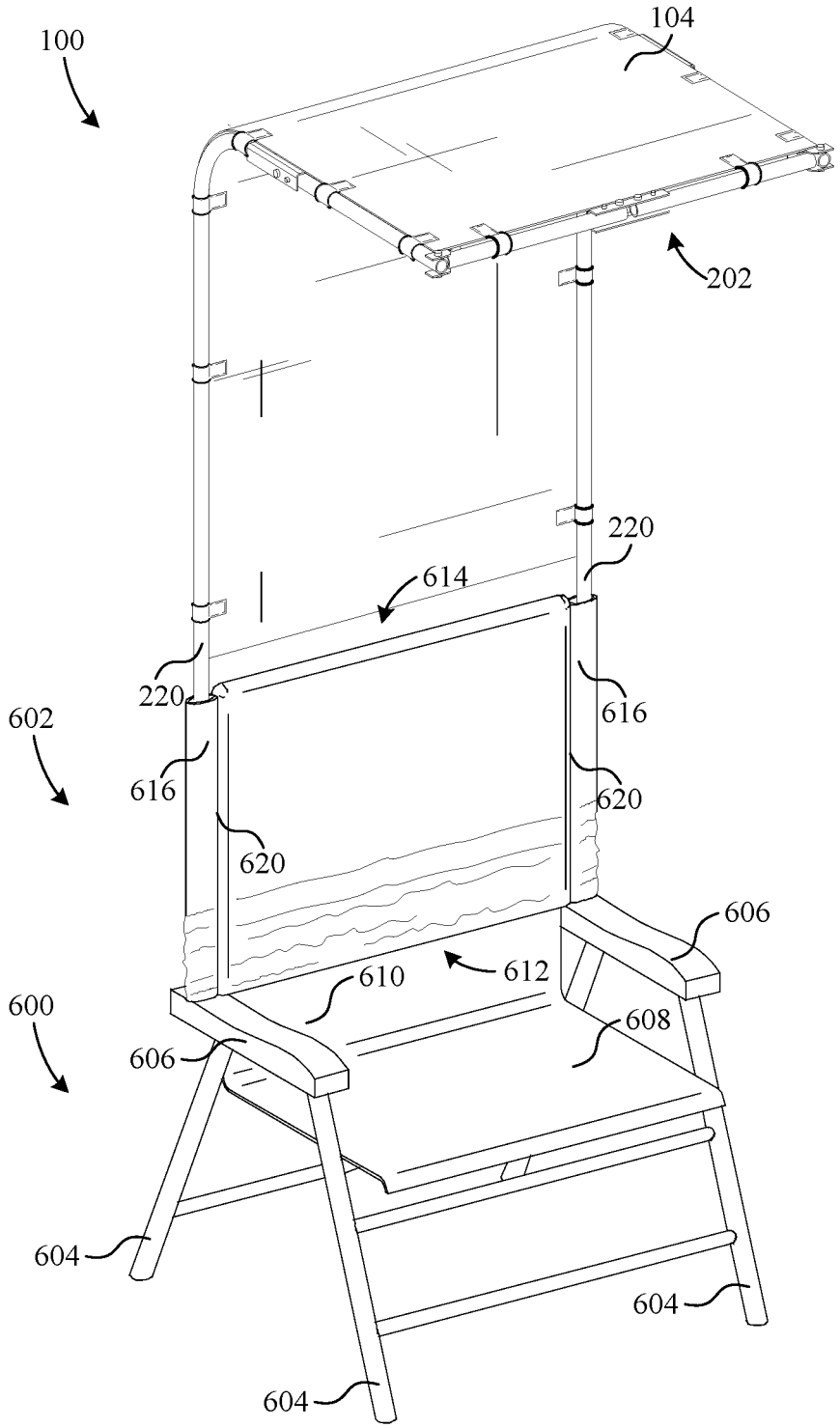
FIG. 7 is a perspective view of the portable awning of FIG. 6 coupled to a chair.

FIG. 7 shows a perspective view of portable seat awning 100 mounted to chair 600 via bag 602. The mounting of portable seat awning 100 to chair 600 via bag 602 is described as follows. First, the top half of portable awning 100 is separated from the bottom half. That is, upper portions 220 of vertical sections 208 are removed from lower portions 222 of vertical sections 208, by pressing push tabs 226 into holes 224 while upper portions 220 and lower portions 222 are pulled in opposite directions. (See FIG. 2) Thus, seat engaging structures 206 (FIG. 2) are removed from frame 106. Then, bag 602 is placed onto chair 600 by positioning open end 612 of bag 602 around backrest 610 of chair 600. Finally, each of upper portions 220 of vertical sections 208 are inserted into a respective one of sleeves 616 as shown.

Figure 8:
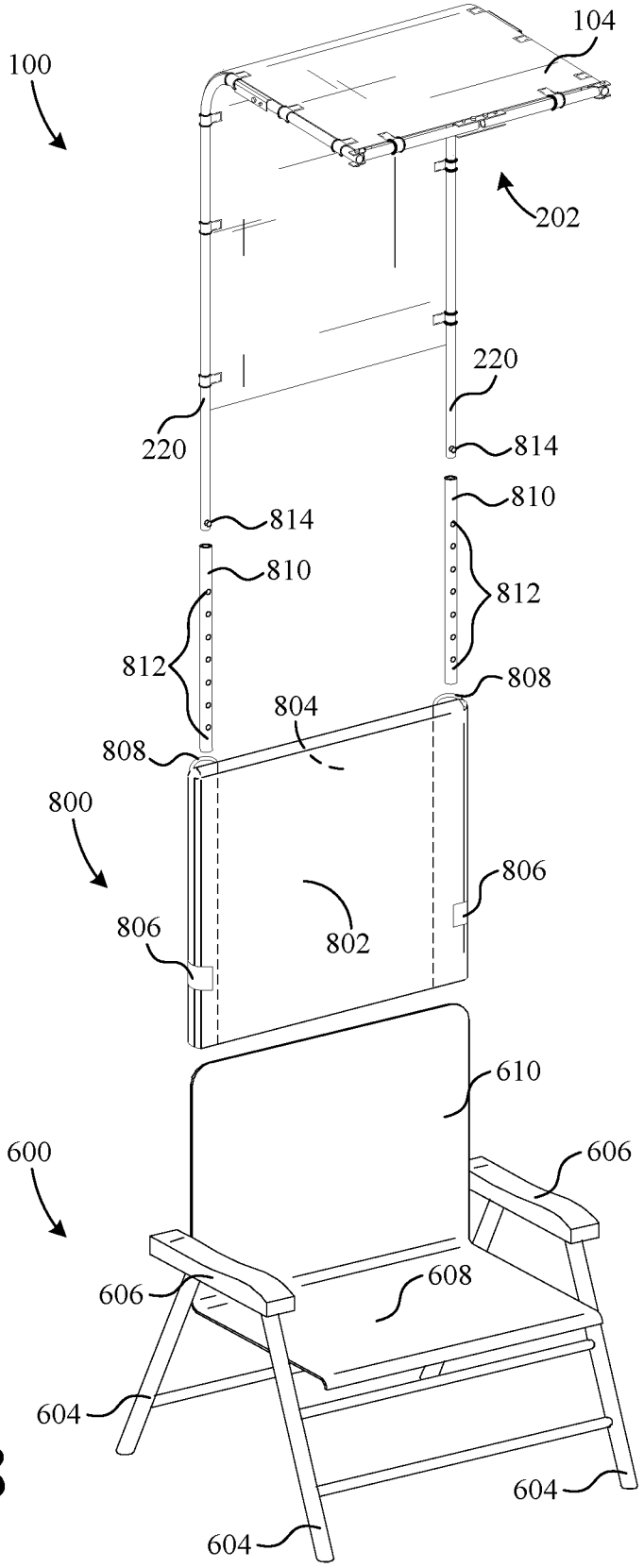
FIG. 8 is a perspective view of the portable awning of FIG. 1 according to yet another embodiment of the present invention.
Figure 9:
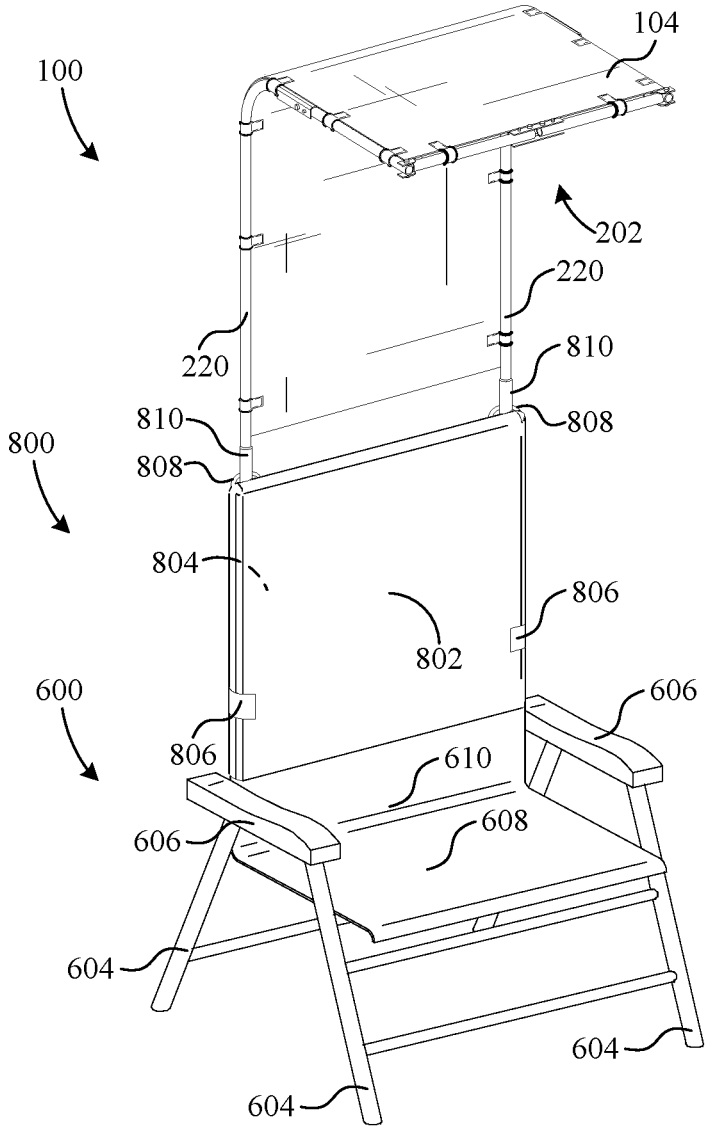
FIG. 9 is a perspective view of the portable awning of FIG. 8 coupled to a chair.

FIG. 8 and FIG. 9 illustrate another embodiment of the present invention, wherein portable seat awning 100 is adapted to be mounted to chair 600 via a fabric awning support 800. FIG. 8 shows an exploded perspective view of portable seat awning 100 removed from chair 600. FIG. 9 shows a perspective view of portable seat awning 100 coupled to chair 600.

In this example, awning support 800 facilitates the coupling of portable seat awning 100 to chair 600. Awning support 800 includes a front region 802 and a back region 804 fastened to one another via hook-and-loop fasteners 806. During use, front region 802 and back region 804 cover (at least partially) the front and back, respectively, of backrest 610 of chair 600. Back region 804 includes a set of sleeves 808 that are adapted to receive upper portions 220 of vertical sections 208. As shown in this example, each of upper portions 220 of vertical sections 208 further includes a telescoping extension 810. Each of extensions 810 is adapted to receive a respective one of upper portions 220. Each of extensions 810 also includes a set of holes 812 that are adapted to receive a push spring 814 of upper portion 220. Accordingly, the length of upper portions 220 and, therefore, the vertical height of awning 100 are adjustable by pressing in push springs 814 and sliding upper portions 220 into and out of telescoping extensions 810.

Figures 10A, 10B, 10C:
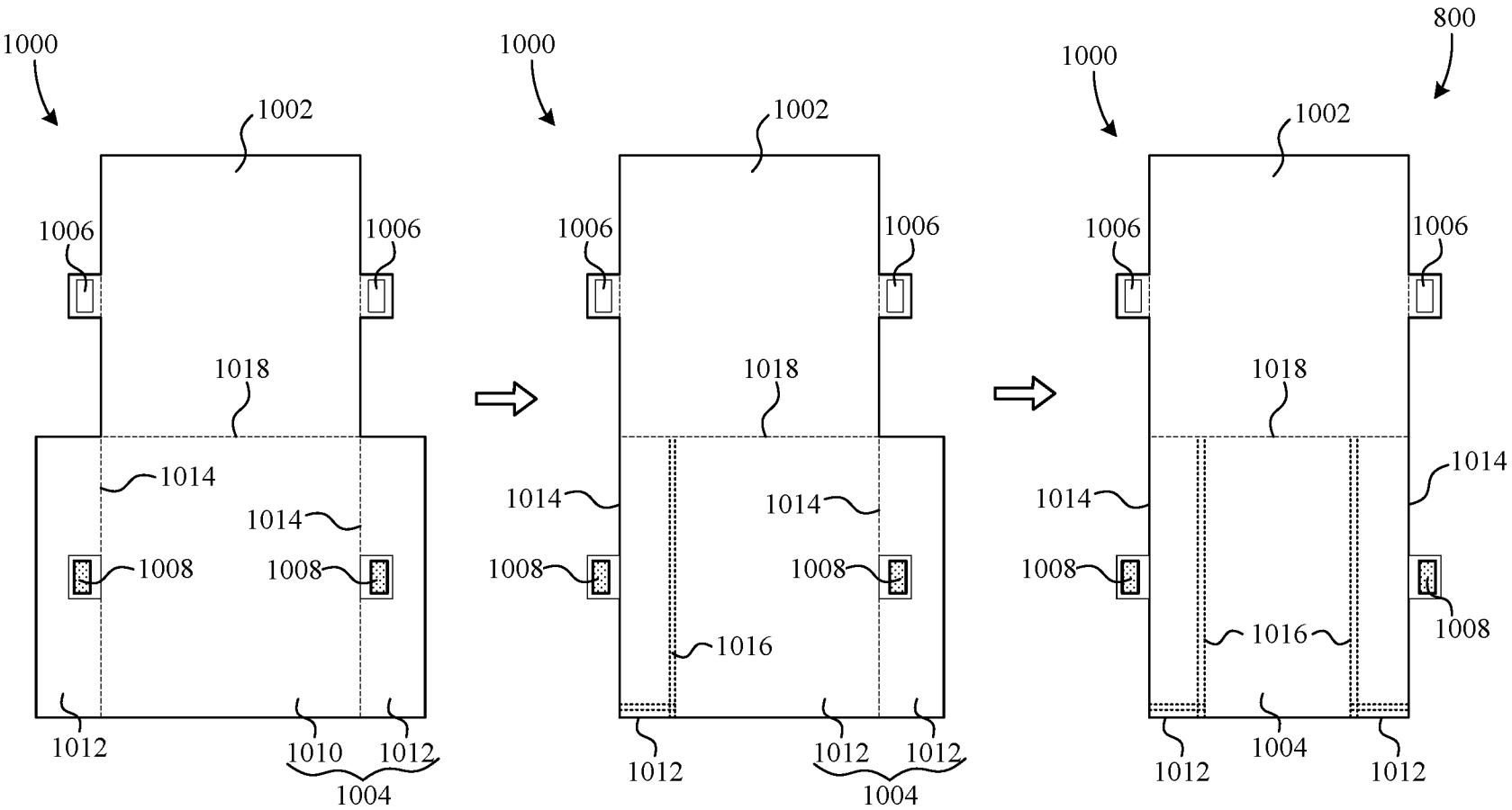
FIG. 10A illustrates the first step of manufacturing the awning support of FIG. 8.
FIG. 10B illustrates the second step of manufacturing the awning support of FIG. 8.
FIG. 10C illustrates the third step of manufacturing the awning support of FIG. 8.

FIGS. 10A through 10C illustrate the manufacturing of awning support 800.

First, as shown in FIG. 10A, a fabric blank 1000 is provided. Fabric blank 1000 includes a first region 1002 and a second region 1004, which are integral parts of a single piece of fabric. First region 1002 has attached a set of hook fasteners 1006 that are adapted to mate with a set of loop fasteners 1008 that are attached on second region 1004. Accordingly, hook fasteners 1006 and loop fasteners 1008, together, form hook and loop fasteners 806 (shown in FIG. 8). Second region 1004 includes a middle region 1010 and a set of side regions 1012 extending outwardly therefrom.

Next, as shown in FIG. 10B, a first one of sleeves 808 is formed. That is, one of side regions 1012 of second region 1004 is folded back along a folding line 1014 (shown in FIG. 10A). Then, the outer edge of the folded one of side regions 1012 is attached to middle region 1010 via stitching 1016, which also closes the bottom of sleeve 808.

Finally, as shown in FIG. 10C, a second one of sleeves 808 is formed. That is, the other of side regions 1012 of second region 1004 is folded back along the other one of folding lines 1014. Then, the outer edge of the other one of the side regions 1012 is attached to middle region 1010 via stitching 1016, which also closes the bottom of the second one of sleeves 808. It should be recognized that first region 1002 and second region 1004 of blank 1000 are formed into front region 802 and a back region 804 of awning support 800.

Once complete, awning support 800 can be attached to chair 600 by draping awning support over backrest 610 of chair 600 such that front region 802 and back region 804 are folded along a fold line 1018. When draped over backrest 610, fold line 1018 should engage the top of backrest 610. With front region 802 and back region 804 engaging the front and back, respectively, of backrest 610, hook fasteners 1006 are coupled to loop fasteners 1008. Once awning support 800 is coupled to chair 600, telescoping extensions 810 can be inserted into sleeves 808.

Figure 11:
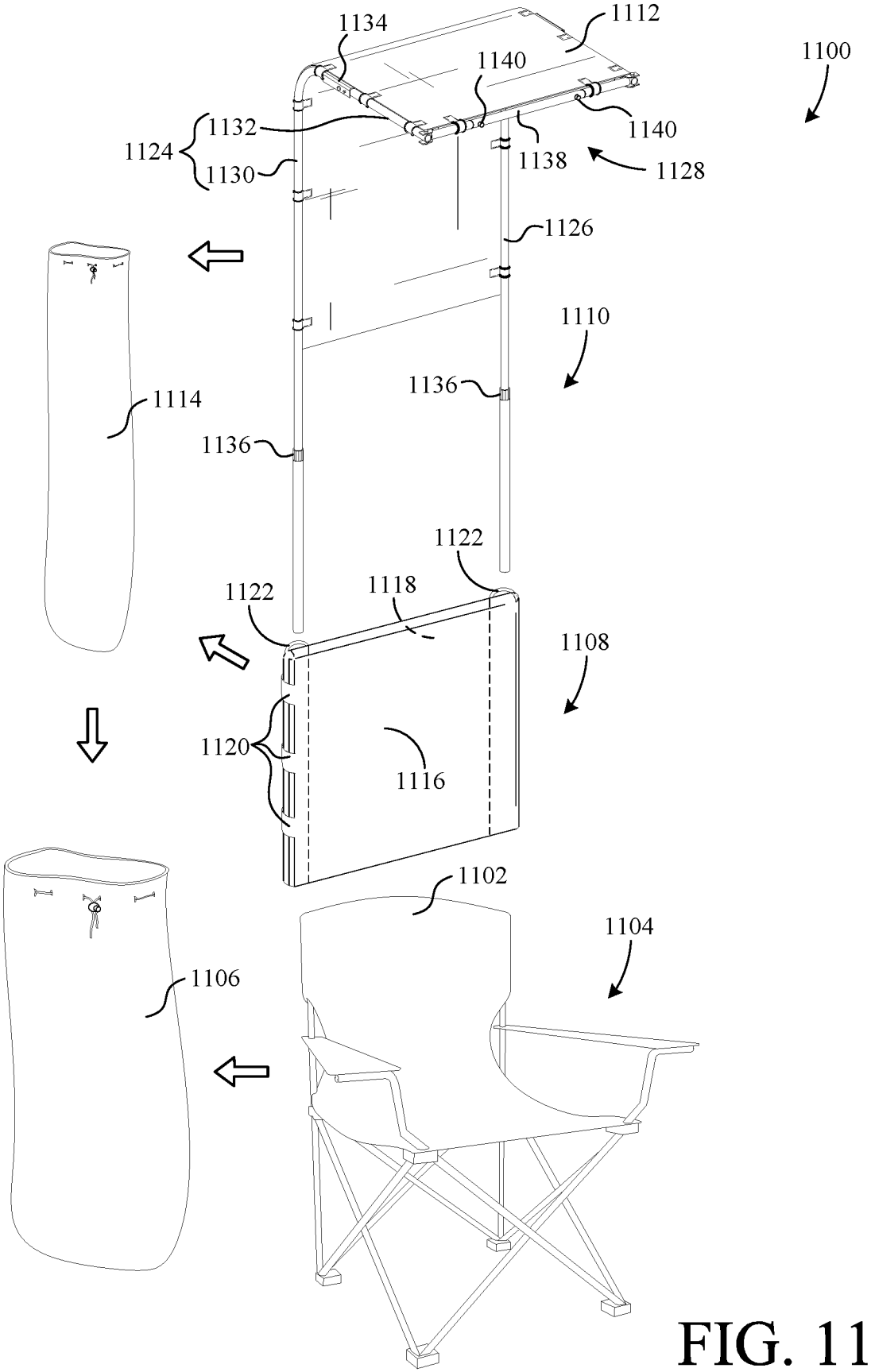
FIG. 11 is a perspective view of a portable awning according to yet another embodiment of the present invention.

FIG. 11 shows a perspective view of a portable seat awning 1100 that is adapted to be mounted on the backrest 1102 of a chair 1104. In this example, chair 1104 is of the type that is collapsible to fit in an elongated chair bag 1106. Unlike traditional folding chairs (e.g., chair 600 of FIG. 6), most of the frame members of chair 1104 are configured to automatically position themselves substantially vertically when chair 1104 is collapsed. This type of chair has become very common and, therefore, the present invention provides a portable seat awning that not only mounts to such a chair, but that also can be collapsed and carried in the same bag as the chair. Another advantageous aspect of the invention is that portable seat awning 1100 is adjustable so as to accommodate for backrests of varying sizes.

Portable seat awning 1100 includes a flexible seat engaging structure 1108, a frame 1110, a flexible cover 1112, and a storage bag 1114.

Seat engaging structure 1108 includes a front section 1116 and a rear section 1118 coupled together via a plurality of fasteners 1120. Fasteners 1120 are of the complementary hook-and-loop type (e.g., Velcro®) in this embodiment and are configured to secure portable seat awning 1100 to chair 1104. Hook-and-loop fasteners 1120 also allow seat engaging structure 1108 to be mounted on backrests of varying sizes. Seat engaging structure 1108 further includes a plurality (e.g., two) of frame receiving structures 1122 which, in this example, are sleeves that are configured to receive portions of frame 1110 therein.

Frame 1110 includes a first frame structure 1124, a second frame structure 1126, and a third frame structure 1128. Each of frame structures 1124 and 1126 includes an adjustable vertical support 1130 that is pivotally (hingably) coupled with respect to a collapsible horizontal support 1132 via a locking hinge assembly 1134, which is substantially similar to locking feature 212 (FIG. 2). Vertical supports 1130 are adjustable in height via a plurality of telescoping members and a position retainer 1136 (e.g., a turn-lock mechanism, etc.) as will be described in more detail below. In this embodiment, third frame structure 1128 includes a removable frame member 1138 which, when removed, allows frame structures 1124 and 1126 to be collapsed toward one another. Flexible cover 1112 is, for example, a piece of fabric removably fastened to frame 1110. As in prior embodiments, flexible cover 1112 can be opaque, windproof, and/or waterproof to protect a user from sun, wind, and/or rain. Flexible cover 1112 can also include one or more flaps that can be positioned over the perimeter of frame 1110 and hang downward so as to cover the top canopy portion of frame 1110.

FIG. 11 also illustrates a process for collapsing and storing portable seat awning 1100 with chair 1104. First, vertical supports 1130 of frame structures 1124 and 1126 are lifted out of sleeves 1122 of seat engaging structure 1108 and adjusted to their minimum heights. Horizontal supports 1132 are folded downward by disengaging their locking hinge assemblies 1134. Frame member 1138 is also removed by pressing in a set of push tabs 1140. Once member 1138 is removed, frame structures 1124 and 1126 are pulled toward one another and disposed in an awning bag 1114 along with member 1138. Seat engaging structure 1108 is also removed from chair 1104 and stored in awning bag 1114. Finally, chair 1104 is collapsed, and awning bag 1114 and chair 1104 are disposed in chair bag 1106. Notably, the opening of awning bag 1114 has a diameter that is less than the distance between frame structures 1124 and 1126 when awning 1100 is deployed.

In other methods of collapsing and storing the awning 1100, seat engaging structure 1108 can optionally be left attached to the backrest 1102 of chair 1104 during storage. As another option, flexible cover 1112 can be stored at least partially engaged with first and second frame structures 1124 and 1126, for example, in a rolled-up fashion. As still another option, the collapsed first and second frame structures 1124 and 1126 can be positioned in the middle of the seat of chair 1104 generally perpendicularly to the front edge of the chair seat. Chair 1104 can then be collapsed into its generally vertical orientation, with the components of the awning 1100 held vertically in the chair seat, and then stored in the chair bag 1106. For these reasons, use of the awning bag 1114 is optional.

Figure 12:
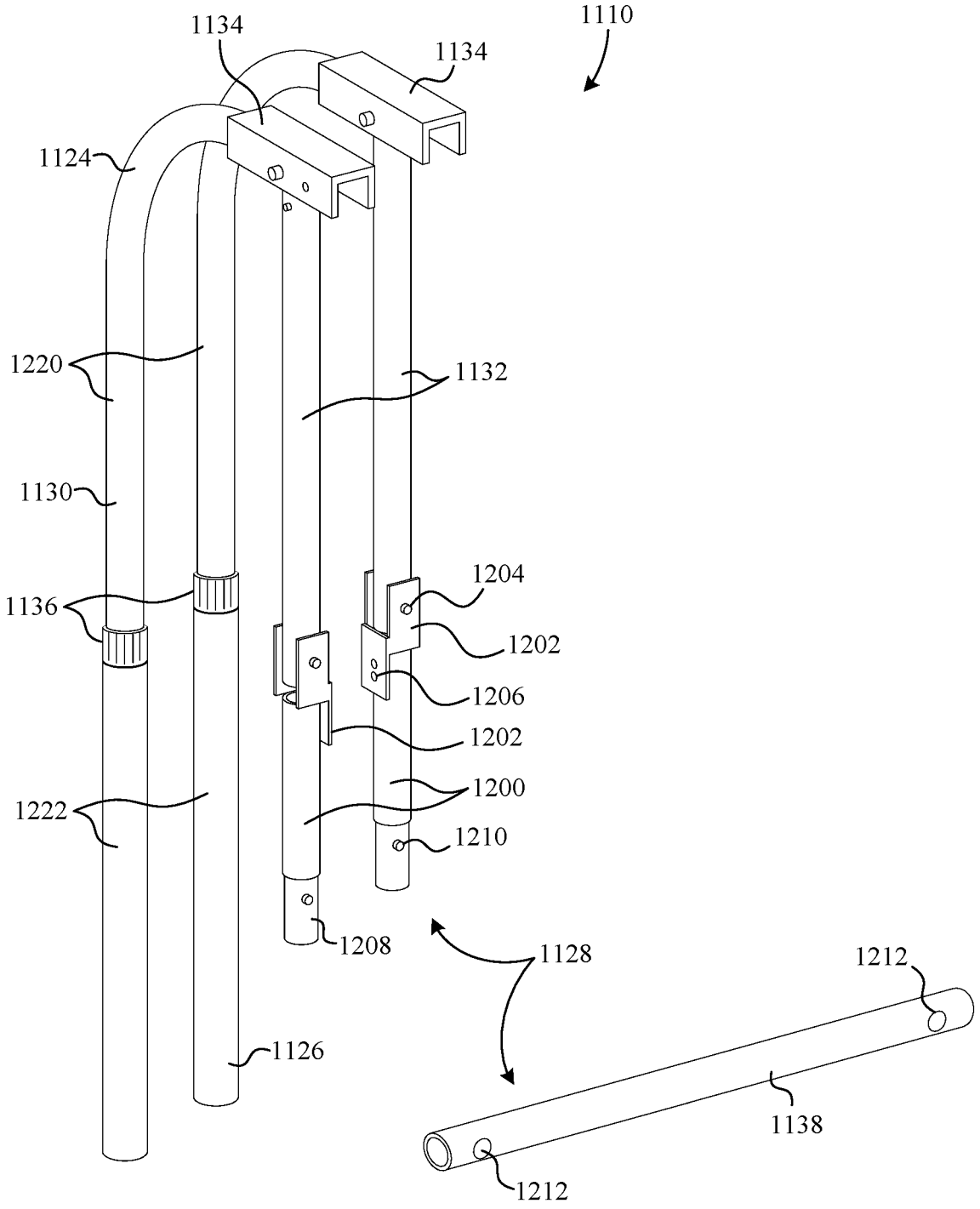
FIG. 12 is a perspective view of the frame of the awning of FIG. 11 in a collapsed state.

FIG. 12 is a perspective view of frame 1110 in a collapsed state. As shown, once frame member 1138 is removed, first frame structure 1124 and second frame structure 1126 can be positioned next to one another. Furthermore, in the collapsed state, horizontal supports 1132 are folded downward.

Third frame structure 1128 is further shown to include a pair of cross members 1200 in this embodiment. When frame member 1138 is removed, cross members 1200 can pivot, via respective hinge structures 1202, to positions that are coaxial with horizontal members 1132 to be oriented downward in a parallel relationship with vertical supports 1130. As shown, each hinge structure 1202 is pivotally coupled to a respective horizontal support 1132 via a hinge pin 1204 and is also fixed to a respective cross member 1200 (e.g., via rivets 1206, welding, etc.). Each cross member 1200 also includes a distal end 1208 having a push tab 1210. The outer diameter of each distal end 1208 is smaller than the inner diameter of frame member 1138 such that cross members 1200 and frame member 1138 can be joined and secured by engaging push tabs 1210 in apertures 1212 formed in frame member 1138.

FIG. 12 further shows that the vertical support 1130 of each of first frame structure 1124 and second frame structure 1126 comprises a plurality of telescoping members, which in this embodiment includes an upper member 1220 and a lower member 1222. The inner diameter of lower member 1222 is slightly larger than the outer diameter of upper member 1220 such that upper member 1220 and lower member 1222 can telescope. This makes vertical support 1130 continuously adjustable in height along a predetermined length (e.g., as determined by the length of lower member 1222, etc.).

A position retainer 1136 is disposed between upper member 1220 and lower member 1222 and functions to selectively retain upper and lower members 1220 and 1222 in position. Unlocking position retainer 1136 frees upper member 1220 and lower member 1222 such that they can be adjusted to give vertical support 1130 a desired length (height). Thereafter, position retainer 1136 can be locked to fix upper and lower members 1220 and 1222 relative to one another.

In a particular embodiment, position retainer 1136 includes a turn-lock mechanism, such as a quarter-turn turn-lock mechanism, whereby turning the turn-lock mechanism in one direction locks members 1220 and 1222 in position, but turning the turn-lock mechanism in the opposite direction frees members 1220 and 1222 to move. A particular turn-lock mechanism that can be employed with embodiments of the present invention comprises a clutch nut having a compression ring. In such a case, the clutch nut slides over the upper member 1220 and screws onto threads (not shown) formed on the upper end of lower member 1222, such that tightening the clutch nut locks the members 1220 and 1222 in position. However, other position retainers providing selective and continuous adjustability between upper and lower members 1220 and 1222 can also be employed. Examples include lever-actuated compression collars, cam locks, hand-turnable set screws, friction material between members 1220 and 1222, etc. Additionally, if each vertical support 1130 includes more than two telescoping members, a position retainer can be employed between each pair of telescoping members.

Figure 13:
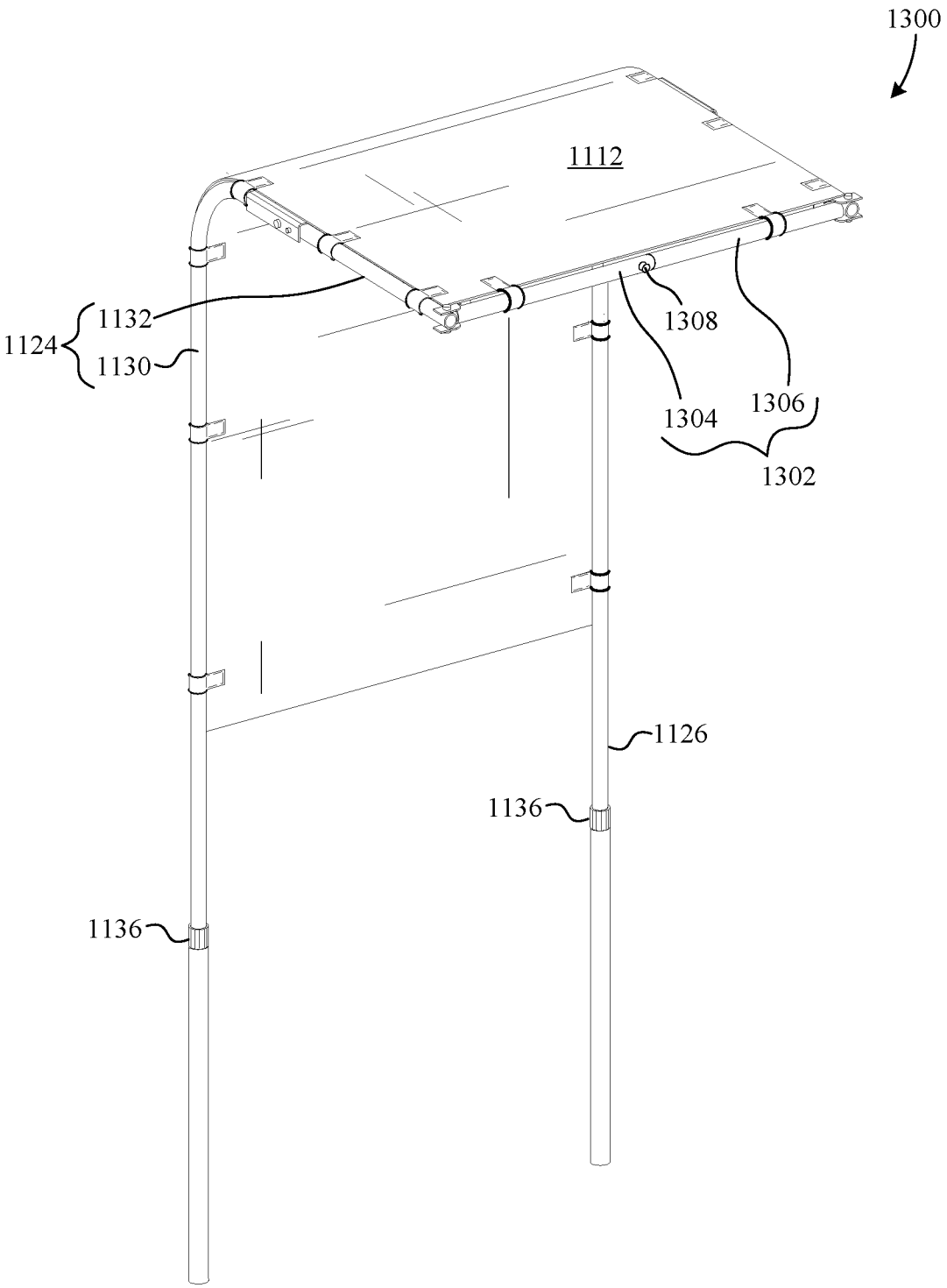
FIG. 13 is a perspective view of a portable awning according to still another embodiment of the present invention.

FIG. 13 is a perspective view of a frame 1300 according to another embodiment of the present invention. Note that frame 1300 is substantially identical to frame 1110. The only difference being that frame 1300 includes an alternative third frame structure 1302 in place of third frame structure 1128. In this particular embodiment, third frame structure 1302 is a two-piece structure having a first cross-member 1304 and a second cross-member 1306, pivotally coupled to horizontal supports 1132 of first frame structure 1124 and second frame structure 1126, respectively. Cross members 1304 and 1306 are also configured to detachably couple to one another by inserting the distal end of one cross member (e.g., cross member 1306) into the distal end of the other (e.g., cross member 1304). Cross members 1304 and 1306 are secured together in a deployed position via a push tab and aperture configuration. Here, cross member 1306 includes a push tab 1308 and cross member 1304 defines an aperture for receiving the push tab 1308.

Figure 14:
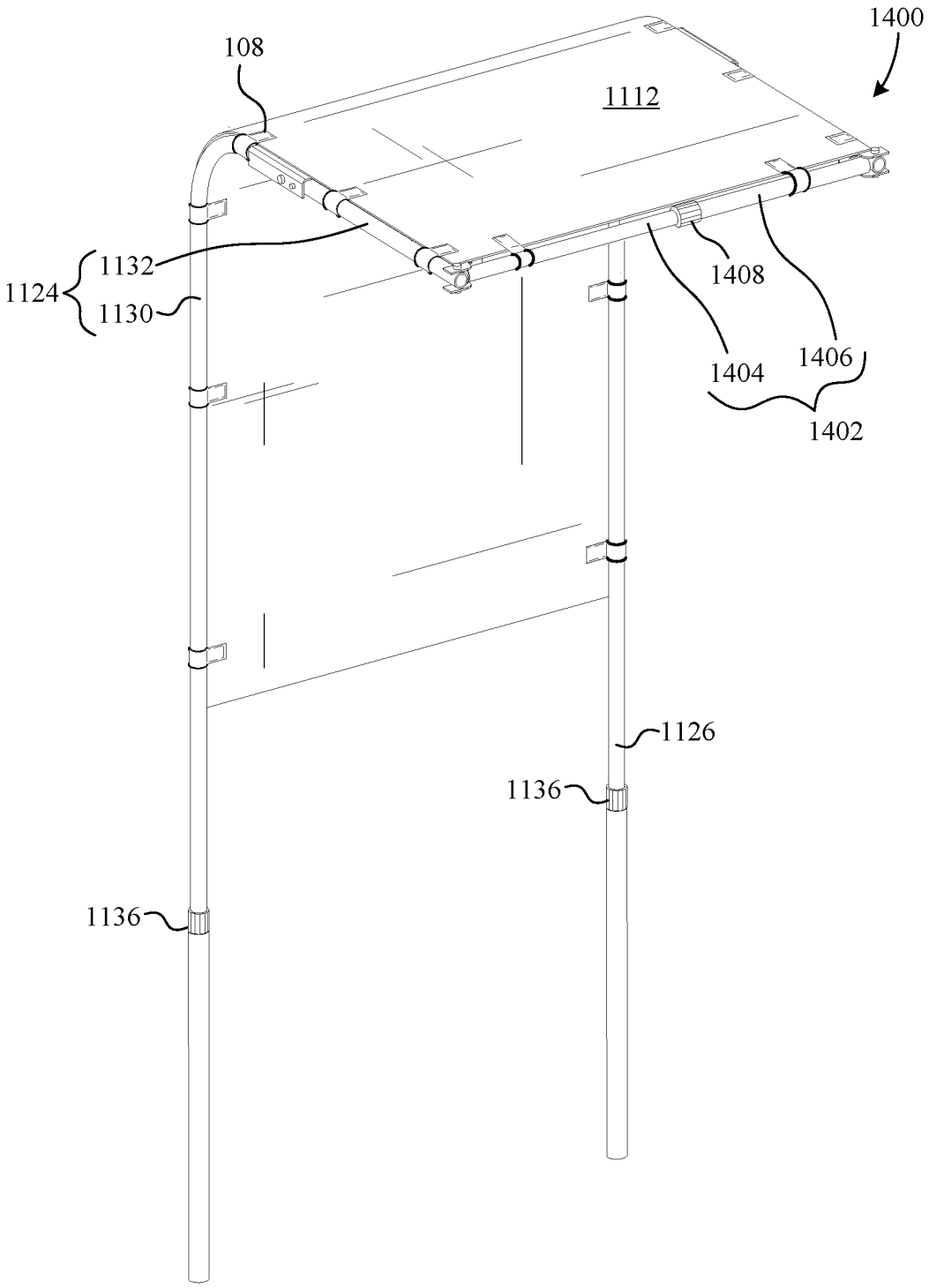
FIG. 14 is a perspective view of a portable awning according to yet another embodiment of the present invention.

FIG. 14 is a perspective view of a frame 1400 according to another embodiment of the present invention. Note that frame 1400 is substantially identical to frame 1110. However, frame 1400 includes an alternative third frame structure 1402 in place of third frame structure 1128. In this particular embodiment, third frame structure 1402 is a two-piece telescoping structure having a first cross member 1404 and a second cross member 1406 that are detachably coupled to one another. More specifically, the outer diameter of one of cross members 1404 and 1406 (e.g., cross member 1404) is smaller than the inner diameter of the other of cross members 1404 and 1406, which facilitates engagement and continuously-adjustable telescopic movement between the two. In addition, first and second cross members 1404 and 1406 are pivotally coupled to horizontal supports 1132 of first and second frame structures 1124 1126, respectively.

The telescoping ability of the cross members 1404 and 1406 allows a user to vary the width of frame 1400 to accommodate for chairs having backrests of different widths. Once first frame structure 1124 and second frame structure 1126 are spaced at a desired distance from one another, cross members 1404 and 1406 can be locked relative to one another via a position retainer 1408 (e.g., a turn-lock mechanism, etc.). The wrap-around hook-and-loop fasteners (e.g., fasteners 108) of fabric flexible cover 1112 enable flexible cover 1112 to accommodate variation in width between first and second frame members 1124 and 1126. Unlocking retainer 1408 enables cross members 1404 and 1406 to move relative to each other as well as separated (e.g., for storage).

Figures 15A, 15B, 15C:
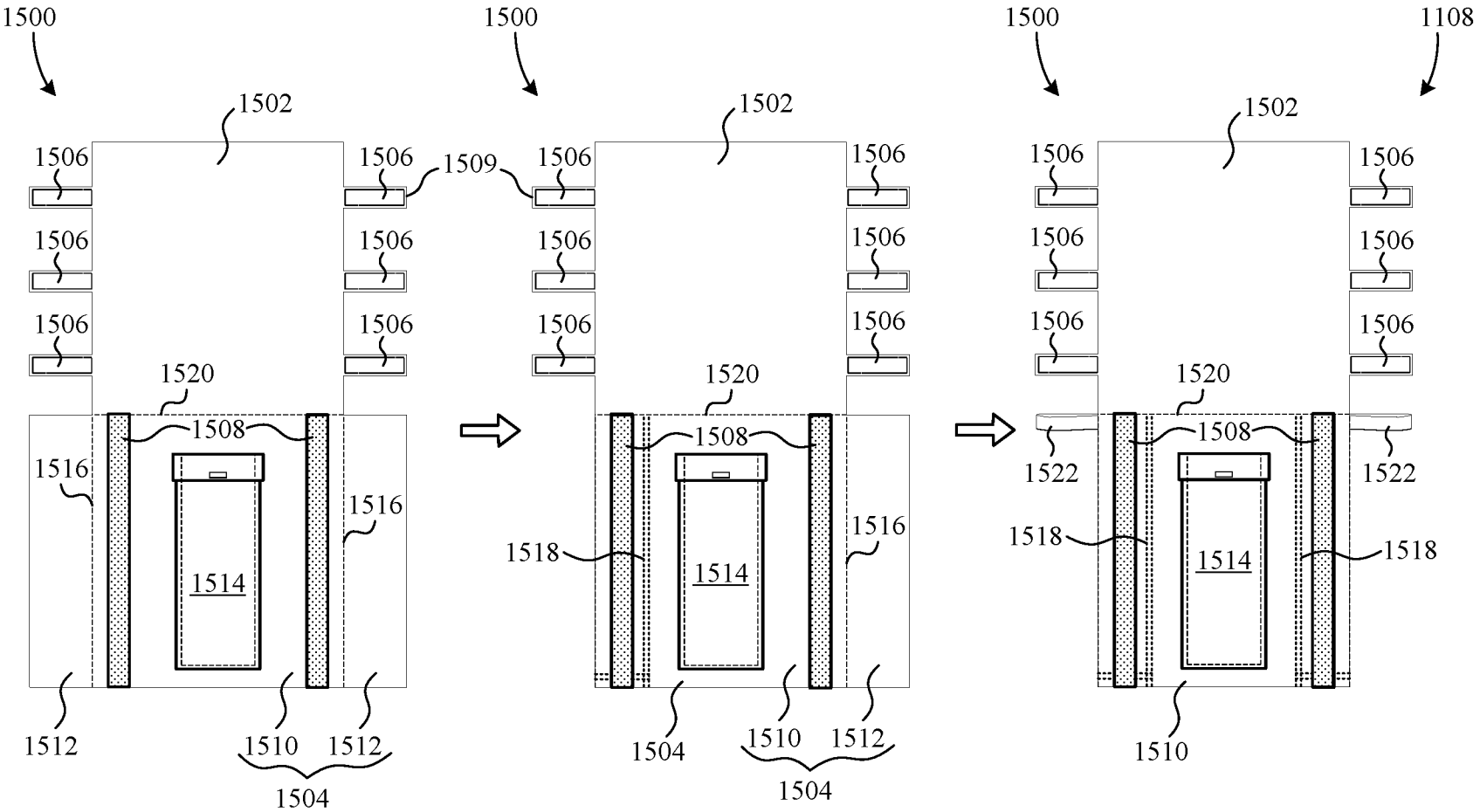
FIG. 15A illustrates a first step of manufacturing the flexible seat engaging structure of FIG. 11.
FIG. 15B illustrates a second step of manufacturing the flexible seat engaging structure of FIG. 11.
FIG. 15C illustrates a third step of manufacturing the flexible seat engaging structure of FIG. 11.

FIGS. 15A through 15C illustrate the manufacturing of seat engaging structure 1108.

First, as shown in FIG. 15A, a fabric blank 1500 is provided. Fabric blank 1500 includes a first region 1502 and a second region 1504, which are integral parts of a single piece of fabric. First region 1502 includes a set of fasteners 1506 affixed thereon that are adapted to mate with a set of complementary set of fasteners 1508 affixed on second region 1504. Together fasteners 1506 and fasteners 1508 form fasteners 1120 (FIG. 11).

Second region 1504 includes a middle region 1510 and a set of side regions 1512 extending outwardly therefrom. Middle region 1510 includes a pouch 1514 that is adapted to receive removable portion(s) of the third frame structure (e.g., frame member 1138) when portable seat awning 1100 is collapsed and stored. Pouch 1514 can be a pre-made pocket element attached (e.g., by sewing, glue, etc.) to middle region 1510 as shown. Alternatively, pouch 1514 can be formed from a lower fabric region (not shown) of blank 1500 that is folded upward from the bottom edge of middle region 1510 and attached to middle region 1510 (e.g., by sewing, gluing, etc.).

In this embodiment, one of the sets of fasteners 1506 and fasteners 1508 comprises loop fasteners, and the other of the sets of fasteners 1506 and 1508 comprises hook fasteners. More specifically, in this embodiment, fasteners 1506 comprise strips of hook material affixed (e.g., sewn, glued, etc.) to horizontal tabs 1509 extending from first region 1502. Fasteners 1508, in contrast, comprise a plurality of long, vertically-oriented strips of loop material affixed to middle region 1510 on the opposite side of fabric blank 1500 as fasteners 1506.

Next, as shown in FIG. 15B, a first one of sleeves 1122 (FIG. 11) is formed. That is, one of side regions 1512 of second region 1504 is folded back along a folding line 1516 (shown in FIG. 15A). Then, the outer edge of the folded one of side regions 1512 is attached to middle region 1510 via stitching 1518, which also closes the bottom of sleeve 1122.

Finally, as shown in FIG. 15C, a second one of sleeves 1122 is formed. That is, the other of side regions 1512 of second region 1504 is folded back along the other one of folding lines 1516. Then, the outer edge of the other one of the side regions 1512 is attached to middle region 1510 via stitching 1518, which also closes the bottom of the second one of sleeves 1122. It should be recognized that first region 1502 and second region 1504 of blank 1000 are formed into front region 1116 and a back region 1118 of seat engaging structure 1108, respectively.

Optionally, a pair of wheel chair couplers 1522 can be attached on opposite edges of blank 1500 and near fold line 1520 so as to engage the push handles of a wheel chair. In this example, wheel chair couplers 1522 are relatively inelastic loops of material. However, loops 1522 can instead be elastic to provide additional tensile support when installed on the push handles of the wheel chair. In this embodiment, loops 1522 are pre-formed and attached (e.g., sewn) to blank 1500. However, loops 1522 could instead be an integral part of blank 1500. In other embodiments, loops 1522 can comprise two-part ties or straps that fasten together.

Once complete, seat engaging structure 1108 can be attached to chair 1104 by draping seat engagement structure 1108 over backrest 1102 of chair 1104 such that front region 1116 and back region 1118 are folded along a fold line 1520 in an intermediate region between front region 1116 and back region 1118. When draped over backrest 1102, fold line 1520 should engage the top of backrest 1102. With front region 1116 and back region 1118 engaging the front and back, respectively, of backrest 1102, the set of fasteners 1506 are coupled to the complementary set of fasteners 1508. Once seat engaging structure 1108 is coupled to chair 1104, vertical supports 1130 can be inserted into sleeves 1122 and the canopy of portable seat awning erected. In the case of a wheel chair, the wheel chair push handles can be passed through loops 1522 as part of the process of draping seat engagement structure 1108 over the backrest of the wheel chair.

Seat engaging structure 1108 provides important advantages. For example, fasteners 1508 extend for substantially the entire height of back region 1118 to facilitate ready attachment of seat engaging structure 1108 to a variety of shapes and sizes of backrests 1102. Any fabric of seat engaging structure 1108 extending beyond the limits of backrest 1102 can also be bunched and fastened using fasteners 1506 and 1508, so that seat engaging structure is securely engaged with backrest 1102. Additionally, the widths of sleeves 1122 provide some tolerance for positioning first and second frame structures 1124 and 1126 at a desired width apart, which also accommodates for backrests 1102 of varying shapes and sizes. Thus, fasteners 1506, fasteners 1508, and sleeves 1122 define width adjustment features of the portable seat awning.

Figure 16:
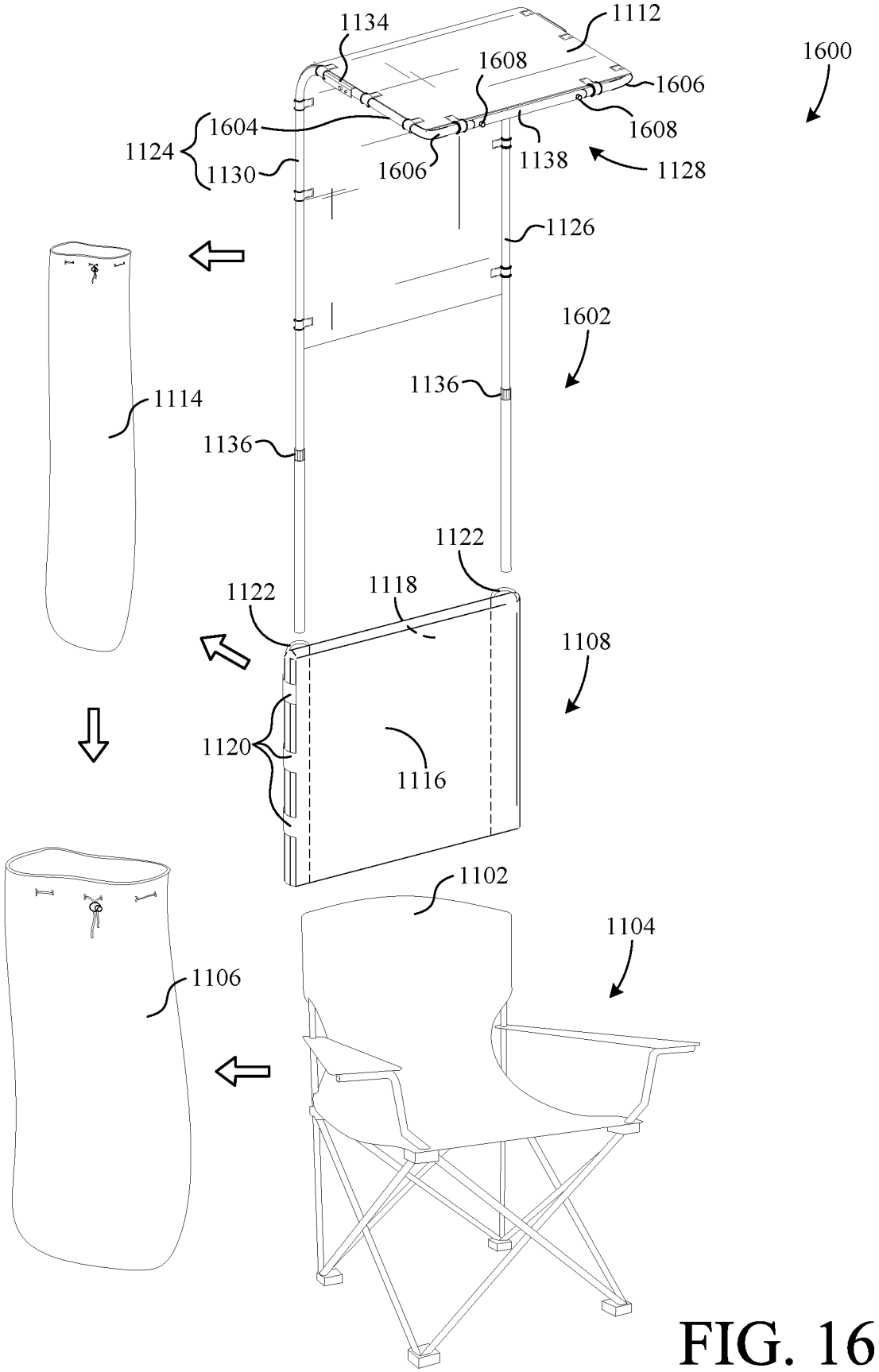
FIG. 16 is a perspective view of a portable awning according to yet another embodiment of the present invention.

FIG. 16 shows a perspective view of a portable seat awning 1600 having an alternative frame 1602. In this example, frame 1602 is substantially the same as frame 1110 of FIG. 11 except that horizontal supports 1132 and hinge structures 1202 are replaced with horizontal supports 1604 having fixed bends 1606 formed therein, respectively, that turn inward. Each of horizontal supports 1604 includes a push tab 1608 that has the same functionality as push tabs 1140 and are, therefore, withheld from the description to avoid redundancy.

Figure 17:
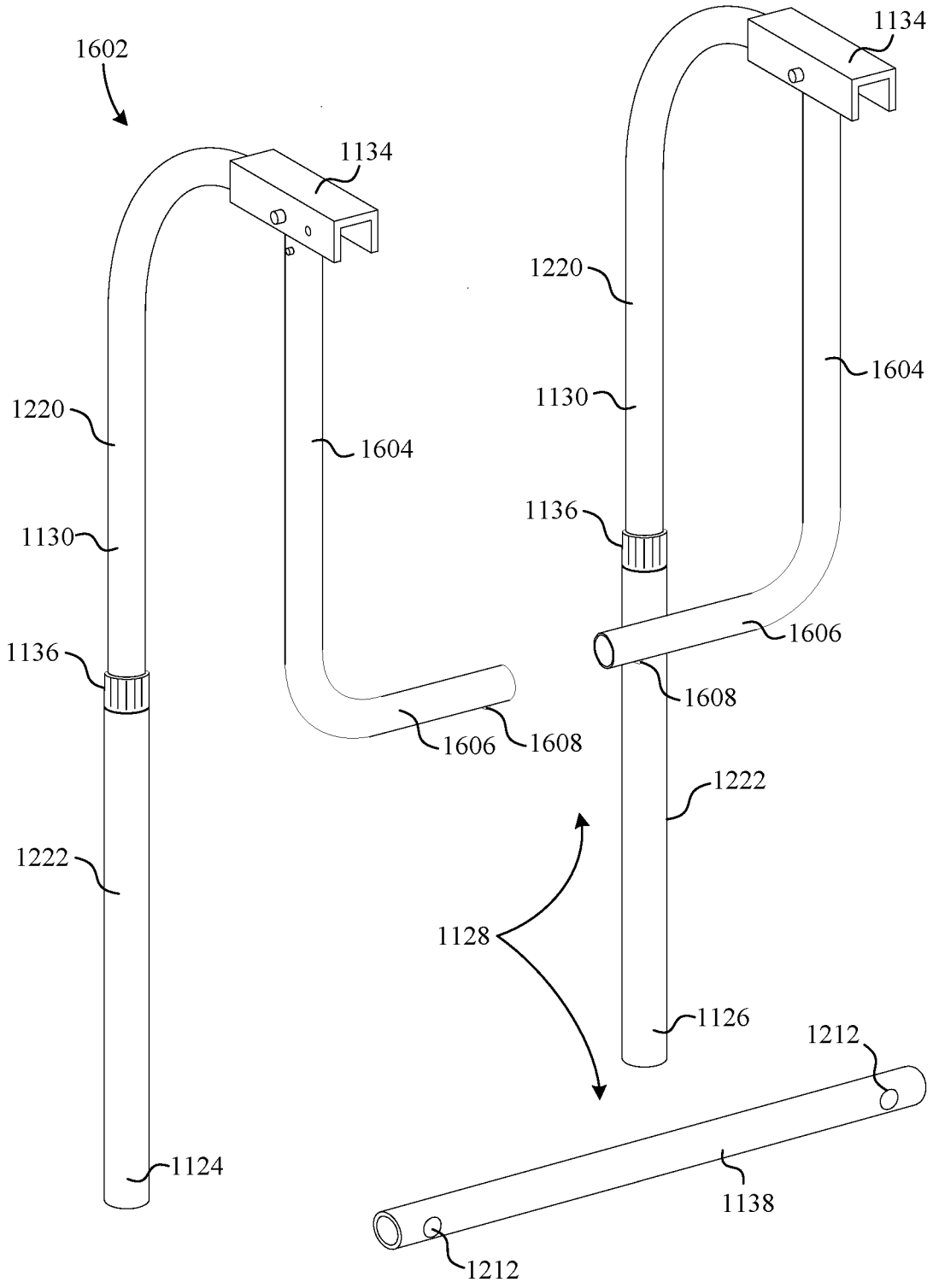
FIG. 17 is a perspective view of the frame of the awning of FIG. 16 in a collapsed state.

FIG. 17 is a perspective view of frame 1602 in a collapsed state. FIG. 17 shows that, in this embodiment, fixed bends 1606 are ninety degree (90°) bends. FIG. 17 also shows that, once frame member 1138 is removed, first frame structure 1124 and second frame structure 1126 can be positioned next to one another (e.g., for storage). Furthermore, in the collapsed state, horizontal supports 1604 are folded downward.

Figure 18:
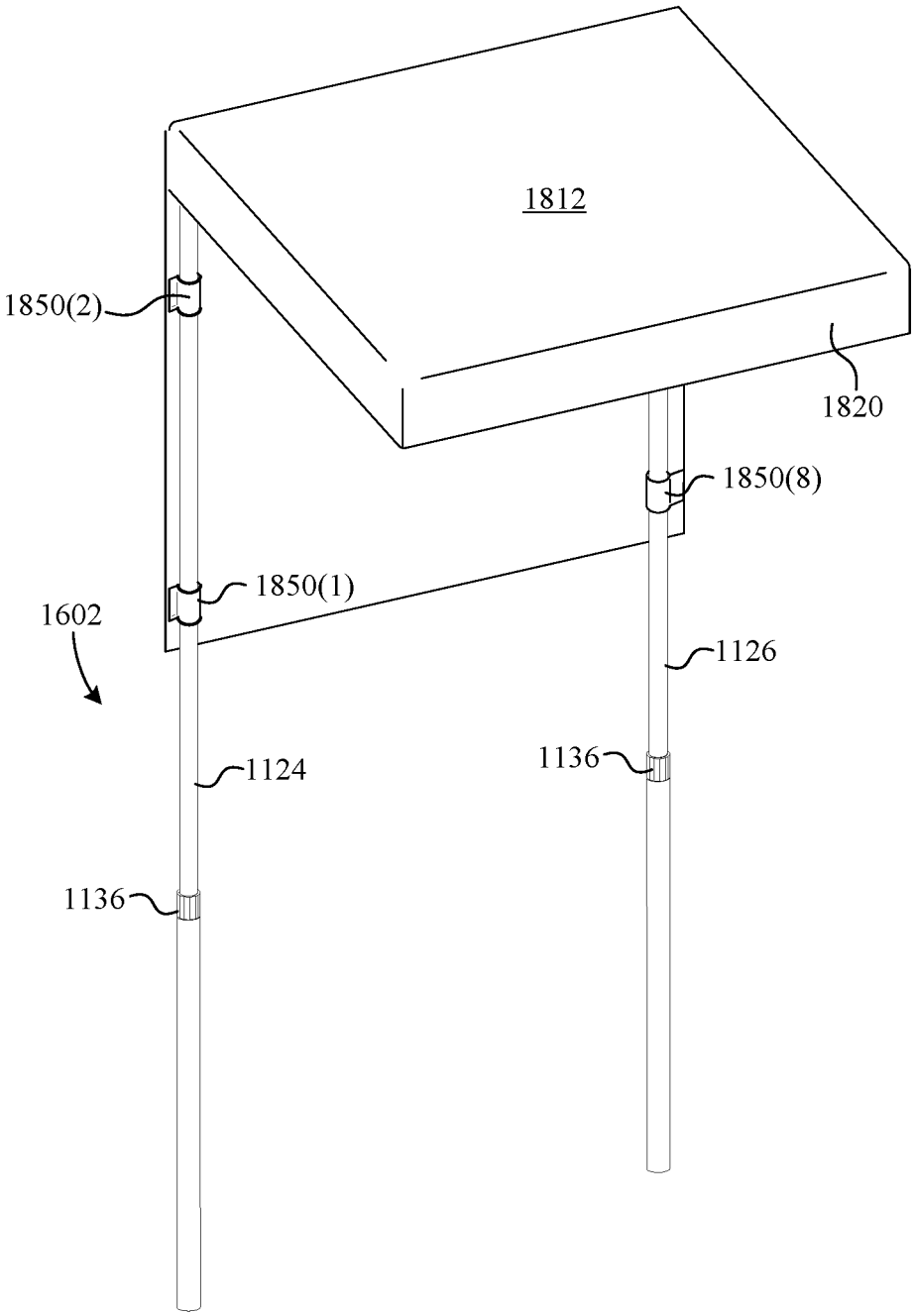
FIG. 18 is a perspective view of a flexible cover for a portable awning according to the present invention.

FIG. 18 is a perspective view of a flexible cover 1812 configured to removably attach to a frame (e.g., frame 1602, etc.) of a portable awning (e.g., portable awning 1600, etc.) of the present invention. In this embodiment, flexible cover 1812 is formed from fabric and includes a flap 1820. Flap 1820 is configured to be positioned around the canopy portion of the awning frame (e.g., around horizontal supports 1604, fixed bends 1606, and frame member 1138). Flexible cover 1812 can be opaque, windproof, and/or waterproof to protect a user from sun, wind, and/or rain.

Flexible cover 1812 is removably coupled to the awning frame via a plurality of flexible loops 1850(1-*n*). In the present embodiment, there are eight loops 1850(1-8), where four loops 1850(1-4) are positioned to receive the first frame structure 1124 therethrough, and the other four loops 1850 (5-8) are positioned to receive the second frame structure 1126 therethrough. Other configurations of loops 1850 can be used depending on the structure of the frame.

Figure 19:
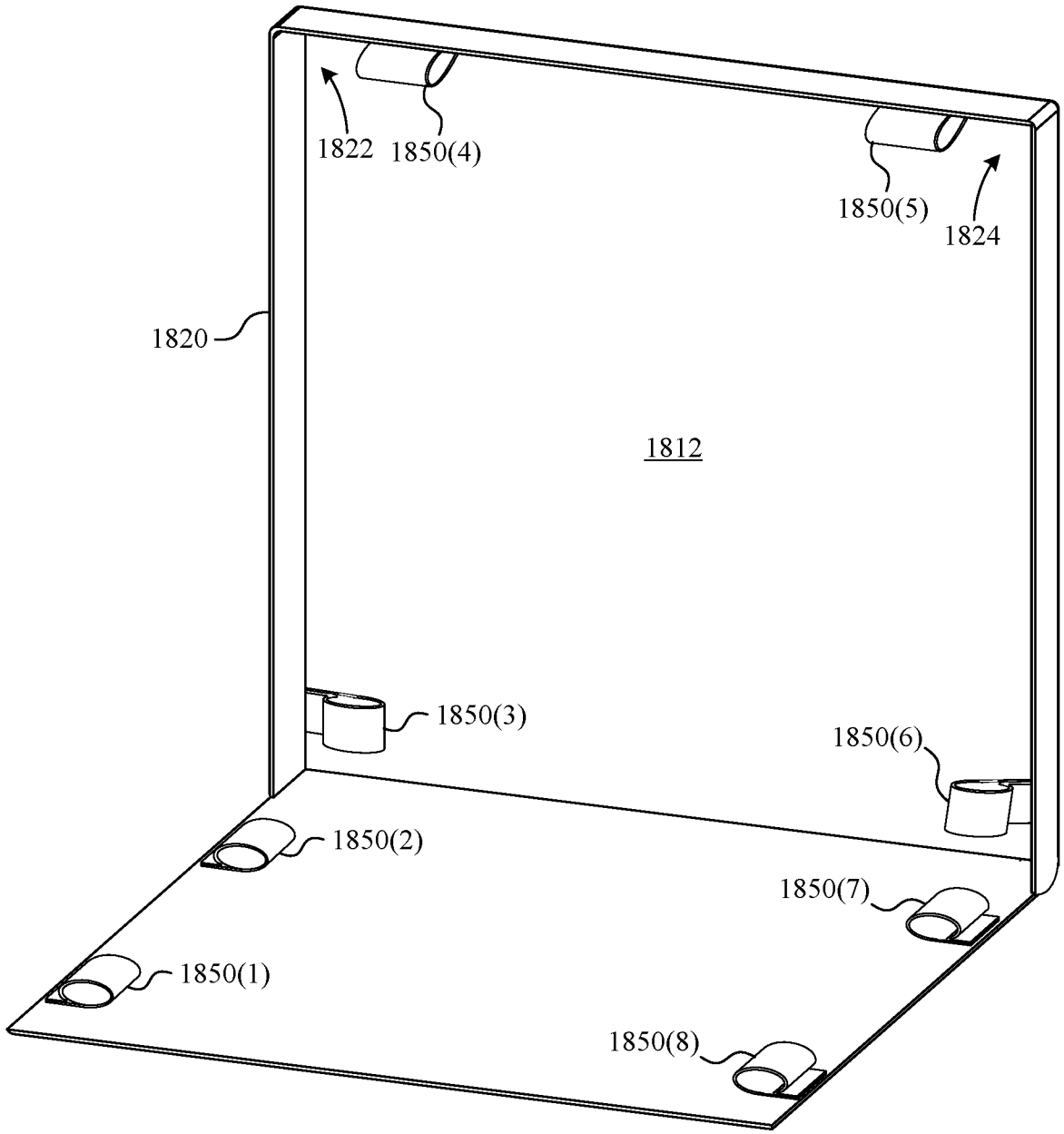
FIG. 19 is another perspective view of the flexible cover of FIG. 18.

FIG. 19 is another perspective view of flexible cover 1812 showing loops 1850(1-8) in greater detail. As shown, loops 1850(1-8) are formed from fabric and are affixed (e.g., sewn, glued, etc.) to the frame side of flexible cover 1812. The inner diameters of loops 1850(1-8) are sized so that frame structures 1124 and 1126 can pass therethrough.

During awning setup, with reference to portable awning 1600, the horizontal support 1604 of first frame structure 1124 is extended and locked in position via locking hinge assembly 1134. Thereafter, the first frame structure 1124 is inserted through each of loops 1150(1-4) such that bend 1606 of frame structure 1124 is located adjacent the corner 1822 of flap 1820 and push tab 1608 is located in between loops 1850(4) and 1850(5). This process is repeated for second frame structure 1126 by extending horizontal support 1604 and passing second frame structure 1126 through loops 1850(5-8) such that bend 1606 is located adjacent the corner 1824 of flap 1820 and push tab 1608 is located in between loops 1850(5) and 1850(4). Thereafter, removable frame member 1138 can be attached to frame structures 1124 and 1126 between loops 1850(4) and 1850(5) via push tabs 1608.

Flexible cover 1812 provides several advantages. For example, loops 1150 and flap 1820 enable flexible cover 1812 to be quickly and correctly positioned relative to frame members 1124 and 1126. Additionally, loops 1850(4) and 1850(5) are positioned near corners 1822 and 1824, respectively, to prevent the inwardly bent portions of horizontal supports 1604 of the first and second frame structures 1124 and 1126 from pulling out of loops 1850(4) and 1850(5), respectively, once installed. This feature speeds up awning setup and storage.

Generally, portable seat awning 1600 including a flexible cover 1812 can be assembled and installed on a chair 1104 as follows. Flexible seat engaging structure 1108 is installed over the backrest 1102 of chair 1104 and secured by engaging fasteners 1506 and 1508. The upper member 1220 is installed in the lower member 1222 for each of first and second frame structures 1124 and 1126 (if not previously completed), structures 1124 and 1126 are adjusted to the desired height, and their respective position retainers 1136 are locked. Horizontal supports 1132 are raised and locked via locking hinge mechanisms 1134. Frame structures 1124 and 1126 are inserted through loops 1850(1-4) and loops 1850(5-8), respectively, of flexible cover 1812. Thereafter, removable frame member 1138 can be attached to the inwardly-bent ends of frame structures 1124 and 1126 via push tabs 1608. The bottom ends of frame structures 1124 and 1126 are inserted into respective frame receiving structures 1122 of seat engaging structure 1108 to position the awning over the chair. Thereafter, the height of awning 1600 can be re-adjusted if desired. The order of the various steps described above can be altered as desired.

Disassembly and storage involves the steps described above with respect to FIG. 11. Advantageously, the frame member 1138 can be stored in pouch 1514 of seat engaging structure 1108. Additionally, as mentioned above, a user is not required to remove the seat engaging structure 1108 from the backrest 1102 and/or the flexible cover 1812 from the frame structures 1124 and 1126 prior to storing the awning 1600 with the chair 1102 in chair bag 1106.

The description of particular embodiments of the present invention is now complete. Many of the described features may be substituted, altered or omitted without departing from the scope of the invention. For example, alternate structural elements (e.g., square stock, angle stock, etc.), may be substituted for the extruded tubular structural elements shown. As another example, alternate fabric types may be substituted for the opaque wind/rain proof fabric 104. These and other deviations from the particular embodiments shown will be apparent to those skilled in the art, particularly in view of the foregoing disclosure.

I claim:

1. A portable seat awning comprising:

a first frame structure configured to be disposed on a first side of said portable seat awning;

a second frame structure configured to be disposed on a second side of said portable seat awning;

a third frame structure configured to be disposed between said first frame structure and said second frame structure, at least a portion of said third frame structure being detachable from at least one of said first frame structure and said second frame structure;

a flexible cover having a first region configured to be coupled to said first frame structure and a second region configured to be coupled to said second frame structure; and a flexible seat engaging structure configured to engage a chair backrest, said flexible seat engaging structure having a first frame structure receiving feature and a second frame structure receiving feature, said first frame structure receiving feature configured to receive said first frame structure and said second frame structure receiving feature configured to receive said second frame structure, said flexible seat engaging structure additionally including at least one width adjustment feature to accommodate for chair backrests of varying widths.

2. The portable seat awning of claim 1, wherein said third frame structure includes a first end pivotally coupled to said first frame structure and a second end pivotally coupled to said second frame structure.

3. The portable seat awning of claim 2, wherein said third frame structure includes a removable structure configured to be disposed between said first end and said second end of said third frame structure.

4. The portable seat awning of claim 1, wherein said flexible seat engaging structure includes a pouch configured to receive said detachable portion of said third frame structure.

5. The portable seat awning of claim 1, wherein said third frame structure includes a first member and a second member;

said first member includes a first end and a second end;

said second member includes a first end and a second end;

said first end of said first member is pivotally coupled to said first frame structure;

said first end of said second member is pivotally coupled to said second frame structure; and said second end of said first member is configured to detachably engage said second end of said second member.

6. The portable seat awning of claim 1, wherein:

said first frame structure includes a first vertical section being adjustable in height; and said second frame structure includes a second vertical section being adjustable in height.

7. The portable seat awning of claim 6, wherein:

said first vertical section includes a first plurality of telescoping members;

said second vertical section includes a second plurality of telescoping members; and said first plurality of telescoping members and said second plurality of telescoping members are continuously adjustable along a predetermined length.

8. The portable seat awning of claim 7, further comprising:

a first position retainer configured to retain said first plurality of telescoping members in a first desired position; and a second position retainer configured to retain said second plurality of telescoping members in a second desired position.

9. The portable seat awning of claim 8, wherein each of said first position retainer and said second position retainer comprises a turn-lock mechanism.

10. The portable seat awning of claim 6, wherein:

said first vertical section of said first frame structure includes a bend that transitions a top end of said first vertical section from a vertical direction to a horizontal direction;

said first frame structure includes a first horizontal section pivotally coupled between said horizontally directed top end of said first vertical section and said third frame structure;

said second vertical section of said second frame structure includes a bend that transitions a top end of said second vertical section from said vertical direction to said horizontal direction; and said second frame structure includes a second horizontal section pivotally coupled between said horizontally directed top end of said second vertical section and said third frame structure.

11. The portable seat awning of claim 10, wherein:

said first horizontal section of said first frame structure includes a first bend turning inward toward said second horizontal section of said second frame structure; and said second horizontal section of said second frame structure includes a second bend turning inward toward said first horizontal section of said first frame member.

12. The portable seat awning of claim 1, wherein:

said flexible seat engaging structure includes a front section, a rear section, and a middle section disposed between said front section and said rear section;

when said middle section of said flexible seat engaging structure is draped over a said chair backrest, said front section hangs in front of said chair backrest, and said rear section hangs behind said chair backrest;

said first frame structure receiving feature and said second frame structure receiving feature are disposed on said rear section of said flexible seat engaging structure a fixed distance from one another;

said width adjustment feature includes a first hook substrate, a first loop substrate, a second hook substrate, and a second loop substrate;

one of said first hook substrate and said first loop substrate is coupled to said front section of said flexible seat engaging structure adjacent a first lateral edge of said front section of said flexible seat engaging structure;

the other of said first hook substrate and said first loop substrate is coupled to said rear section of said flexible seat engaging structure adjacent a first lateral edge of said rear section of said flexible seat engaging structure, whereby said first hook substrate and said first loop substrate can engage one another when said first lateral edge of said front section or said first lateral edge of said rear section is wrapped around a side of said chair backrest;

one of said second hook substrate and said second loop substrate is coupled to said front section of said flexible seat engaging structure adjacent a second lateral edge of said front section of said flexible seat engaging structure opposite said first lateral edge of said front section of said flexible seat engaging structure;

the other of said second hook substrate and said second loop substrate is coupled to said rear section of said flexible seat engaging feature adjacent a second lateral edge of said rear section of said flexible seat engaging structure opposite said first lateral edge of said rear section of said flexible seat engaging structure, whereby said second hook substrate and said second loop substrate can engage one another when said second lateral edge of said front section or said second lateral edge of said rear section is wrapped around a side of said chair backrest; and said first hook substrate and said second hook substrate extend a first predetermined distance in a first direction, said first loop substrate and said second loop substrate extend a second predetermined distance in a second direction different from said first direction, whereby said front section and said rear section can be tightened around said chair back by adjusting an amount of overlap between said first hook substrate and said first loop substrate and between said second hook substrate and said second loop substrate.

13. The portable seat awning of claim 1, further comprising a bag configured to receive said portable seat awning in a collapsed state, said bag defining an opening having a diameter less than the distance between said first and said second frame structures when said portable awning is in a deployed state.

14. The portable seat awning of claim 1, wherein:

said first frame structure includes a first vertical section;

said second frame structure includes a second vertical section;

said first vertical section of said first frame structure includes a bend that transitions a top end of said first vertical section from a vertical direction to a horizontal direction;

said first frame structure includes a first horizontal section pivotally coupled between said horizontally directed top end of said first vertical section and said third frame structure;

said second vertical section of said second frame structure includes a bend that transitions a top end of said second vertical section from said vertical direction to said horizontal direction; and said second frame structure includes a second horizontal section pivotally coupled between said horizontally directed top end of said second vertical section and said third frame structure.

15. The portable seat awning of claim 14, wherein:

said first horizontal section of said first frame structure includes a first bend turning inward toward said second horizontal section of said second frame structure; and said second horizontal section of said second frame structure includes a second bend turning inward toward said first horizontal section of said first frame member.

16. The portable seat awning of claim 1, wherein:

said first frame structure includes a first vertical section and a first horizontal section;

said second frame structure includes a second vertical section and second horizontal section;

said first horizontal section of said first frame structure includes a first bend turning inward toward said second horizontal section of said second frame structure; and said second horizontal section of said second frame structure includes a second bend turning inward toward said first horizontal section of said first frame member.

17. A method of manufacturing a portable seat awning, said method comprising:

forming a first frame structure configured to be disposed on a first side of said portable seat awning;

forming a second frame structure configured to be disposed on a second side of said portable seat awning;

forming a third frame structure configured to be disposed between said first frame structure and said second frame structure, at least a portion of said third frame structure being detachable from said first frame structure and said second frame structure;

forming a flexible cover having a first region configured to be coupled to said first frame structure and a second region coupled to said second frame structure; and forming a flexible seat engaging structure configured to engage a chair backrest, said flexible seat engaging structure having a first frame structure receiving feature configured to receive said first frame structure and a second frame structure receiving feature configured to receive said second frame structure, said flexible seat engaging structure additionally including at least one width adjustment feature to accommodate for chair backrests of varying widths.

18. A portable seat awning comprising:

a first frame structure configured to be disposed on a first side of said portable seat awning, said first frame structure including an upright section and a first transverse section, a bend formed at a top of said upright section transitioning between said upright section and said first transverse section, said first frame structure additionally including a second transverse section pivotally coupled to said first transverse section;

a second frame structure configured to be disposed on a second side of said portable seat awning, said second frame structure including an upright section and a first transverse section, a bend formed at a top of said upright section of said second frame structure transitioning between said upright section of said second frame structure and said first transverse section of said second frame structure, said second frame structure additionally including a second transverse section pivotally coupled to said first transverse section of said second frame structure;

a third frame structure configured to be disposed between said second transverse section of said first frame structure and said second transverse section of said second frame structure, at least a portion of said third frame structure being detachable from at least one of said first frame structure and said second frame structure;

a flexible cover having a first region configured to be coupled to said first frame structure and a second region configured to be coupled to said second frame structure; and a flexible seat engaging structure configured to be draped over a chair backrest, said flexible seat engaging structure including a front section that hangs over a front of said chair backrest when said flexible seat engaging structure is draped over said chair backrest and a rear section that hangs behind said chair backrest when said flexible seat engaging structure is draped over said chair backrest, said front section including a first side edge, and said rear section including a second side edge, said first side edge of said front section being adjustably attachable to said second side edge of said rear section around a first side of said chair backrest, whereby said flexible seat engaging structure can be tightened around said chair backrest, said flexible seat engaging structure additionally having a first frame structure receiving feature and a second frame structure receiving feature, said first frame structure receiving feature being configured to receive said upright section of said first frame structure, and said second frame structure receiving feature being configured to receive said upright section of said second frame structure.

* * * * *